US007484910B2

(12) United States Patent
Mugge

(10) Patent No.: US 7,484,910 B2
(45) Date of Patent: Feb. 3, 2009

(54) WALKWAY STONES SETS; AND, METHODS

(75) Inventor: Jimmie Lloyd Mugge, Inver Grove Heights, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 11/399,947

(22) Filed: Apr. 7, 2006

(65) Prior Publication Data

US 2007/0258766 A1 Nov. 8, 2007

(51) Int. Cl.
*E01C 5/00* (2006.01)

(52) U.S. Cl. ..... 404/34

(58) Field of Classification Search ..... 404/29, 404/34, 40, 42, 36, 35, 39; 52/596, 608, 52/609, 604, 610
See application file for complete search history.

(56) References Cited

U.S. PATENT DOCUMENTS

| | | | | |
|---|---|---|---|---|
| 3,267,823 | A * | 8/1966 | Macrae | 404/41 |
| 3,292,508 | A * | 12/1966 | Anderson | 404/40 |
| 5,350,256 | A * | 9/1994 | Hammer | 405/286 |
| 5,353,569 | A * | 10/1994 | Rodrique | 52/589.1 |
| 5,513,475 | A * | 5/1996 | Schaaf et al. | 52/606 |
| 6,073,411 | A * | 6/2000 | Ciccarello | 52/589.1 |
| D439,677 | S * | 3/2001 | Mattox | D25/113 |
| 6,907,705 | B2 * | 6/2005 | Dean et al. | 52/608 |
| D540,954 | S * | 4/2007 | Bouchard | D25/113 |
| 2003/0182011 | A1 * | 9/2003 | Scherer | 700/117 |
| 2004/0250495 | A1 * | 12/2004 | Manthei | 52/589.1 |
| 2006/0179777 | A1 * | 8/2006 | Tufts et al. | 52/596 |
| 2006/0290020 | A1 * | 12/2006 | Tufts et al. | 264/40.1 |
| 2007/0028548 | A1 * | 2/2007 | Johnson et al. | 52/596 |
| 2007/0098945 | A2 * | 5/2007 | Riccobene | 428/44 |
| 2007/0193181 | A1 * | 8/2007 | Klettenberg et al. | 52/596 |

FOREIGN PATENT DOCUMENTS

| | | | |
|---|---|---|---|
| DE | 202 14 207 U1 | | 11/2002 |
| EP | 0 724 039 | * | 7/1996 |
| EP | 0 724 039 A1 | | 7/1996 |

OTHER PUBLICATIONS

Pavestone website, http://web.archive.org/web/20041205133715/http://www.pavestone.com/retail/patio-sandstone.html;http://web.archive.org/web/20050208185016/www.pavestone.com/about/index.html (see Attachment A).*

Marshalls, "Landscape Product to Transform Your Lifestyle," cover page and pp. 45, 49, 2005 brochure.

(Continued)

*Primary Examiner*—Raymond W Addie
(74) *Attorney, Agent, or Firm*—Merchant & Gould P.C.

(57) ABSTRACT

A cast stone set is provided comprising at least four molded stones each having an irregular perimeter. The stones are configured to fit within a hypothetical defining border as defined. The stones can be used to form a patio stone landscape feature such as a patio or walkway, or to form a stepping path. In selected uses, the stones can be reordered from being positioned with the hypothetical defining border. Methods of use and manufacture are described.

2 Claims, 12 Drawing Sheets

OTHER PUBLICATIONS

Bradstone, "Naturally Preferred" brochure, 3 pages, © 2005.

Matt Stone, "Garden Walk" brochure, 2 pages, © 2002.

Oldcastle Architectural, Inc., "Portage Stepping Stones" brochure, 3 pages (available prior to Apr. 7, 2006).

Bend Industries "Cast Natural Garden and Walkway Stones" advertisement, 2 pages (available prior to Apr. 7, 2006).

Pavestone Company, "The Pavestone Sandstone System" brochure, 3 pages, p. 9, © 1998.

Declaration of Jimmie Mugge.

* cited by examiner

WALKWAY STONES SETS; AND, METHODS

FIELD OF THE INVENTION

The present disclosure relates to cast or molded stones configured for use as walkway stones, for example in walkways, patios or in stepping paths. Convenient arrangements comprising stones and collections of such stones in sets, kits, collections, arrangements or groups, are provided.

BACKGROUND OF THE INVENTION

In general, stone walkways, stepping paths and patios are widely used in landscaping. The present disclosure relates to advantageous molded or cast stone arrangements, usable as walkway stones for example, in walkways, in stepping stone paths and/or in patios.

Herein the term "walkway stone" is made to refer to the stone configured to be used as a base, for stepping upon, for example in a walkway, patio or stepping path. The term "walkway" is meant to include patios or walkways, in which the stones are configured. The term "walkway" is meant to refer to an arrangement in which individual stones are positioned in alignment next to one another, in an X, Y orientation. That is, the stones are not organized merely in a line (straight or curved) of single, spaced, stones; rather, within the walkway, many stones have adjacent stones at two, roughly perpendicular, sides. The terms "stepway" or "stepping path" as used herein, are meant to refer to the utilization of stones as a series of steps in a line of spaced, individual, stones in which the line is straight or curved.

SUMMARY OF THE INVENTION

Herein techniques relating to molded or cast stones, and sets of molded or cast stones, are provided. With typical applications of the techniques described herein, the stones will be dry cast stones, having been formed in a dry cast concrete process. Such dry cast stones, will typically have a base which is planar and granular in texture, with the absence of protruding irregularities. Opposite the base, is typically provided an upper or stepping surface, which, when the stones are used, is directed upwardly in the resulting walk patio or stepping path.

Herein the stones are described with respect to a variety of features. Example features include: the perimeter areas of the stones; the perimeter shapes of the stones; the ratio of longest length to widest width of the stones; the longest length; the longest width; the weight (or mass) of each stone; and, stepping surface characteristics of the stones.

Selected sets of, and features of, the stones described herein are also characterized with respect to a hypothetical defining border. The hypothetical defining border, is a border in which all of the stones of a set can be positioned next to one another, in accord with the descriptions herein. A typical hypothetical defining border is a right angle parallelogram, typically a rectangle or square. Specific examples depicted herein involve square hypothetical defining borders, with sets of stones comprising at least four and not more than six stones, typically four or five stones per set.

Techniques for construction of the stones are also described. The techniques include approaches to forming a set of stones in one operation, for a convenient, efficient, manufacturing process.

Uses of the stones in various arrangements such as walkways, patio sections or stepping paths, are described.

Herein a variety of specific detailed characterizations are made, for the examples shown. There is no specific requirement that a stone, or a set of stones, include all of the features characterized, to be in accord with the principles discussed herein. However, inclusion of many of the features characterized provides for particularly advantageous stone sets.

DETAILED DESCRIPTION OF THE PREFERRED EMBODIMENT

I. Features of Typical Molded Stone Arrangements

A. Two Example Arrangements, FIGS. 1, 2, and 7.

Figure 1:
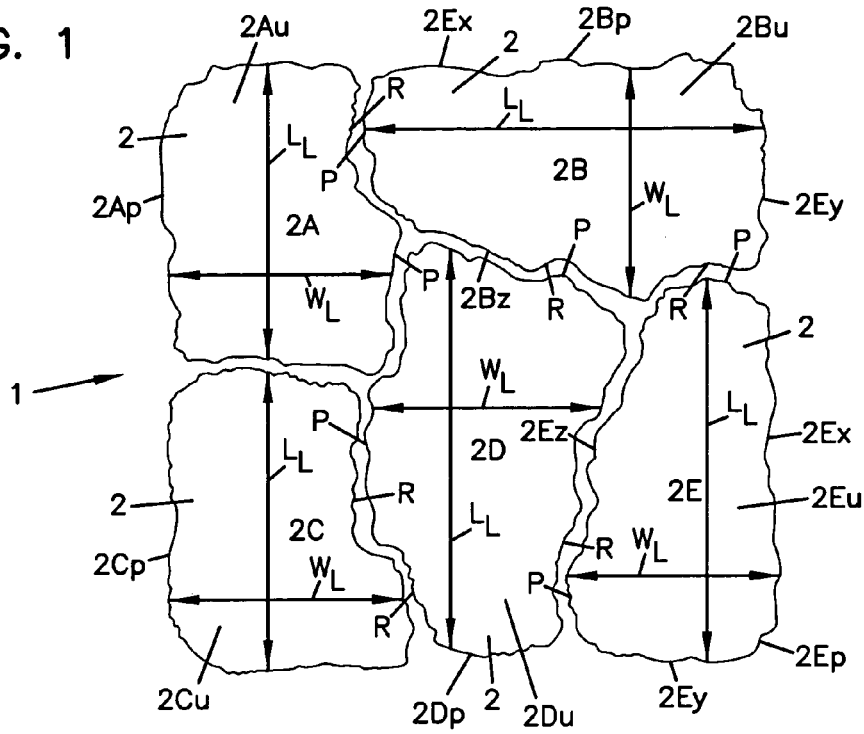
FIG. 1 is a schematic plan view of a set, collection or arrangement of molded or cast walkway stones according to the present disclosure.

In FIG. 1, an example walkway stone set, collection or arrangement 1 according to the present disclosure is shown. A second set collection or arrangement is shown at 100, in FIG. 7. The terms "set, collection or arrangement" and variants thereof (including for example, the terms "kit" and "group") as used herein are meant to refer to a set or kit of individual stones that are shaped or configured in general as characterized herein, and which can be fit or be positioned next to, and associated with, one another, in a hypothetical defining border, as described. It is not meant that the stones are limited to being positioned in such an arrangement, in all types of uses. Further it is noted that after formation, when the individual stones are taken to a landscaping site, they can be further chipped or cut before being set into position for use. The terms "set," "collection," "kit," "group", "arrangement," and similar terms when used to refer to the arrangement 1, FIG. 1, are intended to be alternative characterizations for identifying a group of stones in accord with the present description.

Herein, in some instances the stones described, will be characterized as used in a "landscaping project" by a "landscaper" or by similar terms. These terms alone are not meant to suggest the utilization is necessarily by a professional landscaper as opposed to by a person involved in do-it-yourself (diy) project. The terms are merely meant to refer to a typical type of use of the stones, by a typical user, whether professional or otherwise.

Referring to FIG. 1, the set, collection or arrangement 1 comprises a plurality of walkway stones 2. In FIG. 1, the stones 2 are depicted schematically. That is, the stones 2 are depicted only with a perimeter outline of each stone 2 provided, and without surface texturing. Further, in FIG. 1 the stones 2 are shown in a top plan view; the outlined surfaces depicted comprising surfaces that would typically be directed upwardly, as upper, walking or stepping surfaces, when the stones 2 are positioned for use. The terms "walking surface", "stepping surface" and variants thereof, are meant to refer to a surface of an identified patio stone 2, that is configured to be positioned directed upwardly for a person to step upon, when the stones are incorporated into a patio, walkway or stepping path, as characterized. (An opposite surface, to the upper, walking or stepping surface, is sometimes referred to as a base or bottom surface.)

The particular example shown comprises a set, collection or arrangement 1 including five stones 2, though alternative numbers of stones are possible as discussed below. Each of the stones 2, identified as 2A, 2B, 2C, 2D and 2E, respectively (i.e., 2A-2E), has an outer perimeter indicated at 2Ap-2Ep. For the example shown, the outer perimeter 2Ap-2Ep, for each of the stones 2A-2E is both irregular and jagged in shape. The term "irregular" in this context, is meant to refer to an outer perimeter which does not precisely define a regular geometric pattern; i.e., circle, oval, square, triangle, etc. The term "jagged" means the perimeter is: (a) devoid of straight segments each of which is any longer than 3 inches (7.6 cm); (b) devoid of any regular pattern of angles or curves; and, (c) devoid of any smooth curve extending over a distance of greater than 6 inches (15.2 cm). Thus, what is meant by the term "jagged" in this context, is that each stone is somewhat jagged along perimeter edges, with localized projections and recesses. The "irregular and jagged" nature of the outer perimeter for each stone, facilitates appearance of a natural, rough cut, stone item.

Each of the stones 2 is a cast or molded patio stone. By "cast or molded" in this context, it is meant that the stones 2 are not cut from natural stone, but rather each stone 2 is made by process involving casting or molding of a granular (concrete) mold fill. In this characterization, it will be understood that in typical applications according to the present disclosure, the stones 2 are manufactured and configured to provide an impression of natural stones when used in a patio walkway or stepping path. Typical methods and materials for preparation of such stones are described below.

Each stone 2 is appropriate for use as a stepping stone, if desired, or as a stone in a stone set in a walking path or in a patio section, as discussed below. It is noted that for some patios, walking paths or stepways, the landscaper or user of the stones 2 may choose to further change the size and shape of the stones, by cutting or chipping at the worksite.

As formed (before any landscape site cutting or chipping), each of the stones 2 is typically as follows:

(a) The perimeter area of each one of the stones 2 (i.e., 2A-2E) is at least 1.3 sq. feet (0.121 sq. m.), typically at least 1.5 sq. feet (0.139 sq. meter) and not greater than 3.5 sq. feet (0.325 sq. meter). In typical applications of the principles described herein, each of the stones 2 (e.g. 2A-2E) will have a perimeter area of at least 1.5 sq. feet (0.14 sq. meter) and not greater than 3.4 sq. feet (0.30 sq. m.). For the particular set of five stones depicted in FIGS. 1 and 2, each stone 2 has a perimeter area of at least 1.5 sq. feet (0.14 sq. m) and not greater than 2.2 sq. feet (0.20 sq. m.). For the particular set of four stones depicted in FIG. 7, each stone has a perimeter area of at least 1.6 sq. feet (0.15 sq. m.), and not larger than 3.3 sq. feet (0.31 sq. m.). The perimeter area of a stone 2(e.g., stones 2A-2E), as used herein, is meant to refer to the area defined within the outer perimeter of the stone 2, when the stone 2 is positioned with an upper surface for normal use surrounded by and defined by the perimeter. The actual upper surface area can vary slightly from the perimeter area, since the upper surface can be non-planer, but rather can have contours or other features as discussed therein.

(b) In typical applications of the techniques described herein, the ratio of a longest length dimension ($L_L$) of a stone to a longest width dimension ($W_L$) of the same stone, for each stone, is at least 1.1 and not greater than 2.5. Often this ratio is within the range of 1.15-2.0, inclusive; usually within the range of 1.20-1.95, inclusive. Herein the "longest length" dimension, i.e., $L_L$ will be approximated by a longest dimension across each stone, when positioned as a set in a hypothetical defining border as characterized below, between two furthest spaced apart end sections and generally parallel to a side of a hypothetical defining border, whereas the longest width dimension, i.e. $W_L$ will be the longest dimension across the stone in a direction perpendicular to a line defining the longest length ($L_L$) dimension. For each of the stones depicted in FIGS. 1 and 7, the approximate longest length dimension is indicated by double headed arrows $L_L$, and the approximate longest width dimension is indicated by double headed arrows, $W_L$. It is not intended that the longest length dimension be taken as a diagonal across furthest remote tips or corners, of the stones 2.

(c) In many applications of the techniques described herein, each stone is at least 1.0 inch (2.54 cm) in maximum thickness and usually not greater than 3.0 inches (7.6 cm) in maximum thickness. Typically, each stone 2, is within the range of 1.5-2.5 inches, inclusive (3.8-6.4 cm) in maximum thickness, for example 1.75-2.25 inches (4.5-5.7 cm) thick in maximum thickness. The "thickness" or "maximum thickness" dimension is a distance between opposite upper and lower surfaces when the stone is positioned for use, i.e. with a stepping surface directed upwardly. In typical manufacturing process, the stones will be made to a fixed minimal thickness, for example 1.75 inches (4.5 cm), with any additional grain or texture on surface adding to the thickness.

(d) The longest length dimension ($L_L$) of each stone is typically at least 15 inches (38.1 cm) and usually not more than 30 inches (76.2 cm), when longest length ($L_L$) is as previously defined. Typically $L_L$ is within the range of 17 inches-28 inches (43.2-71.0 cm), inclusive. For a set of five stones, typically the longest length $L_L$ is within the range of 18 inches-26 inches (44.7 cm-66 cm), inclusive; and, when the set of stones is a set of four stones (FIG. 7) the longest length dimension is typically within the range of about 23 inches-28 inches (58.4-71.1 cm), inclusive. In each case, however, alternates are possible with application as certain principles characterized herein.

(e) The longest width dimension ($W_L$) of each stone is typically at least 10 inches (25.4 cm) and usually not more than 24 inches (60.96 cm), when $W_L$ is as previously defined. Often the longest width dimension ($W_L$) is within the range of 11 inches-24 inches (27.9-60.96 cm), inclusive. When the set of stones is a set of five stones, FIG. 1, typically the longest width, $W_L$, is within the range of 12 inches-16 inches (30.5-40.6 cm), inclusive; and, when the stone set is a set of four stones (FIG. 7) the longest width $W_L$ is typically within the range of 12 inches-24 inches (30.5-61 cm), inclusive.

(f) The weight (or mass when stated in kg) of each stone is often at least 25 lbs. (11.3 kg) and usually not more than 65 lbs. (29.5 kg). Typically, the weight (or mass when stated in kg) is within the range 30 lbs.-60 lbs. (13.6-27.2 kg), inclusive. When there are five stones in the set, typically the weight (or mass) of the stones will be within the range of 30-43 lbs., inclusive (13.6-19.5 kg), inclusive. When there are four stones in the set, typically the weight (or mass) range is 30 lbs.-60 lbs. (13.6-27.2 kg), inclusive. It is noted that in each instance, alternatives are possible, with application of certain principles characterized herein.

(g) Each stone 2 (in the example shown, stones 2A-2E) has a relatively flat "ideal or natural stepping surface." The term "ideal or natural stepping surface" as used herein, is meant to refer to a portion of the upper or stepping surface normally oriented upward, to be stepped upon, when the stones are used in a patio, walkway or stepping path. By "relatively flat" in its context, it is meant that the referenced surface portion is not necessarily perfectly planar, but rather it can have irregular features allowing for an appearance of natural rock. Typically the ideal or natural stepping surface is devoid of any feature, in "immediate relief", of greater than 0.4 inch (1.0 cm), and typically none greater than 0.3 inches (0.76 cm). The term "immediate relief" in this context, is meant to refer to a feature of relief for a first point of reference on the ideal or natural stepping surface (i.e., an identified surface location) by comparison to any adjacent second point of reference or surface location (on the ideal or natural stepping surface) that is spaced, linearly, no further than 1 inch (2.5 cm) from the first point of reference. The term "linearly" in this context, is meant to refer to in a lateral direction, when the stones 2A-2E are viewed in a top perspective view as shown in FIG. 1. That is, the linear distance of 1 inch (2.54 cm) described, is meant to refer to a distance in projection from a given location, as opposed to an actual surface distance by taking into account contouring in the surface. Typically the maximum relief in the "ideal or natural stepping surface", i.e., the maximum difference between the highest point and the lowest point in that region of the stone surface, is no greater than 0.5 inch (1.27 cm), and typically no more than 0.3 inch (0.76 cm).

(1) The "ideal or natural stepping surface portion" does not necessarily comprise the entire upper or stepping surface of each one of the stones 2. Rather, it at least comprises a portion of the upper surface of the stones 2, generally centrally located within any given stone 2, having a shape and size where the foot will typically land if centered on the stone 2, when walking. Such an ideal or natural surface portion generally has an area of at least about 90 sq. inches (580 sq. cm), typically at least about 120 sq. inches (774 sq. cm.). Also typically the longest dimension of the "ideal or natural surface," has a length of at least 10 inches (25.4 cm), typically 12-15 inches, (30.5-38.1 cm) and a width of at least 6 inches (15.2 cm), typically 6-9 inches (15.2-22.9 cm). The ideal or natural stepping surface can be viewed as the portion of the upper surface of each stone 2, centrally located within the stone perimeter, toward which a person's foot would naturally or normally be directed during stepping, if the intent of the person is to center the foot on the stone 2. In many instances, there will be a stone border around the natural stepping surface portion which is at least 0.5 inches (1.27 cm) wide. In some instances, however, the ideal or natural stepping surface portion will comprise the entire upper or stepping surface of the stone.

(2) It is noted that away from, or around, the ideal or natural stepping surface portion, when the entire upper surface is not the ideal stepping surface, the stones 2 can be provided with regions of different local relief, to further facilitate the appearance of natural stone. That is, outside of the ideal or natural stepping surface portion, for example around some or all of the ideal or natural stepping surface portion, the upper surface of the stones 2 can include a local relief greater than in the ideal or natural stepping surface portion, for example of up to about 1 inch (2.5 cm) but, typically no more than about 0.5 inch (1.27 cm), from immediately surrounding regions, i.e. regions in the border not more than 1 inch (2.5 cm) from the point selected.

(3) It is noted that when the stones 2 are to be used in a patio, on which chairs, tables or other fixtures may be placed, it will be desirable to provide the stones 2 with a relatively flat complete upper surface, with minimal local relief throughout the entire surface. Thus, in such instances, the degree of flatness characterized above for the ideal or natural stepping surface will be preferred. However, when primarily used for walking, i.e., a walking path or stepping stones, the characterizations provided, which can include an ideal or natural stepping surface, surrounded by regions of greater surface irregularity, may be used, in some instances. Typically, set collection or arrangement (1, FIG. 1, or 100, FIG. 7), will be made so that is useful for both a patio section and a stepping path. In such instances, the entire upper surface will typically need to conform with the preferred definition for the ideal natural stepping surface, as previously characterized.

In typical applications of the techniques described herein, each stone (as molded or cast) will correspond with these features. There is no requirement, however, that every stone correspond with all the features (a)-(g) for the stone set, collection or arrangement 1 to have at least some desirable characteristics according to the present disclosure. Further, it is noted that after molding, for example during a landscaping operation, individual stones 2 may be modified from the molded or cast shape, by cutting or chipping, to fit the particular intended use.

For the particular example set, collection or arrangement 1 depicted, the stones 2 (e.g., 2A-2E) vary in specific perimeter definition. That is, no two of the stones 2 (e.g. 2A-2E) in the set, collection or arrangement 1 have identical outer perimeter shapes. Preferably each stone has a "visually distinguishable" outer perimeter shape from others in the same collection or arrangement 1. By the term "visually distinguishable" in this context, it is meant that even on a cursory visual inspection, differences in the shapes of any two compared stones within the set, collection or arrangement will be apparent. This is desirable, to help provide a natural stone appearance. That is, requiring the stones 2 of each set to each have a "visually distinguishable appearance relative to other stones 2 in the same set", helps avoid a "manufactured" or "patterned" appearance to the resulting landscaped feature, i.e., patio, walkway or stepping path. Many of the principles of the present disclosure can be implemented in sets of stones, in which two or more of the stones within the set do not have visually distinguishable outer perimeter shapes. The above is meant to indicate that, in general, such arrangements will not be typical.

Typically each one of the stones 2 (e.g., stones 2A-2E, FIG. 1 and stones 2F-2I, FIG. 7) has opposite surfaces comprising: (a) a first stepping or upper surface indicated at 2Au-2Eu in FIG. 1 or 2F-2I in FIG. 7, which is a decorative surface intended to be positioned directed upwardly (to be stepped upon) when the stones 2 are used to define a walkway, stepping path or patio; and, (b) an opposite surface to the upper surface 4Au-4Eu, not depicted, but indicated in FIG. 6 at arrow 8. The surface opposite the stepping surface, defined herein as a lower or base surface, is typically made flat and featureless. In more general terms, the lower base surface is typically planar, smooth, and without protruding irregularities, but has a grain texture (similar to a sand grain feel) which will result from the method of manufacture. The base surface is typically free of irregular protrudings, textured, portions; for example resulting from bubbles or unsettled material during manufacture. Herein, what is said that the lower base surface is "without protruding irregularities" or "free of protruding irregularities", and by variants thereof, it is meant that the lower or base surface does not include any localized protrusions or convex portions, with keep the bottom surface from sitting stable and flat, when positioned on a flat surface. In some instances, the lower surface can include localized concave regions or holes therein, if desired, which would not effect the overall flatness and stability of the bottom surface.

Figure 6:
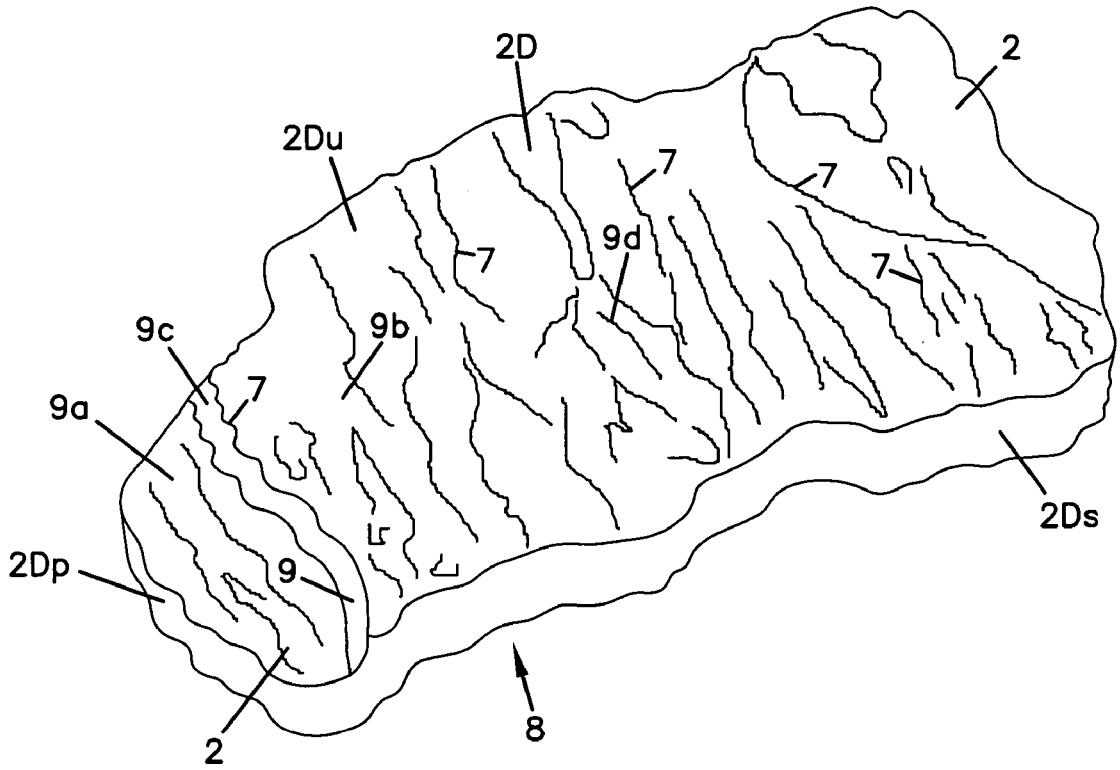
FIG. 6 is a schematic, perspective view of one of the stones depicted in FIGS. 1-5.

Still referring to FIG. 6, it is noted that for the example shown, an optional feature 9 appearing like a fracture is positioned in an end of the stone 2, away from the ideal or natural stepping surface, which would typically be indicated where shown at 9*d*. Thus, the fracture feature 9 is located toward an outer periphery, from the ideal or natural stepping surface 9*d*.

Referring to FIG. 6, an example stone 2 is depicted, in particular a stone having a perimeter shape corresponding to stone 2D from FIG. 1. In FIG. 6, a perspective view is provided. The outer perimeter 2Dp is viewable, defined by side 2Ds. The upper surface or stepping surface 2Du, is depicted with surface irregularities and/or grain 7, to simulate natural stone. At 9, a simulated fracture providing the appearance of a natural rock facet or break, is shown. This provides regions 9*a* and 9*b* that are in separate approximate planes with surface 9*c* therebetween and, with different thicknesses for corresponding regions of the stone 2. The fracture 9 (and resulting surface 9*c*) separates the approximate planes or regions (or drop down) 9*a*, 9*b* by a distance corresponding to approximately 0.4-0.7 inches (1-1.8 cm). Herein surface 9*a* will be referred to as a "drop down area" or by similar terms, by comparison to surface region 9*b*. It is noted that in typical stone sets, drop down areas will not be desireable as they will negatively effect the overall "flatness" for use as a patio section, with tables or chairs thereon.

It is noted that the specific shape and jagged edge pattern of each stone 2, within the general applications of the principles described herein, is a matter of choice for aesthetics. Thus, the specific jagged edge definition for the outer perimeter of each stone, will typically be chosen based on design or aesthetic concern. Alternately stated, the general principles described herein can be applied with a wide variety of alternate specific perimeter shapes. However, in each set, collection or arrangement (1, FIG. 1; or 100, FIG. 7), selected general (i.e., non-specific) perimeter shapes and definitions which can be useful, are described below.

Figure 2:
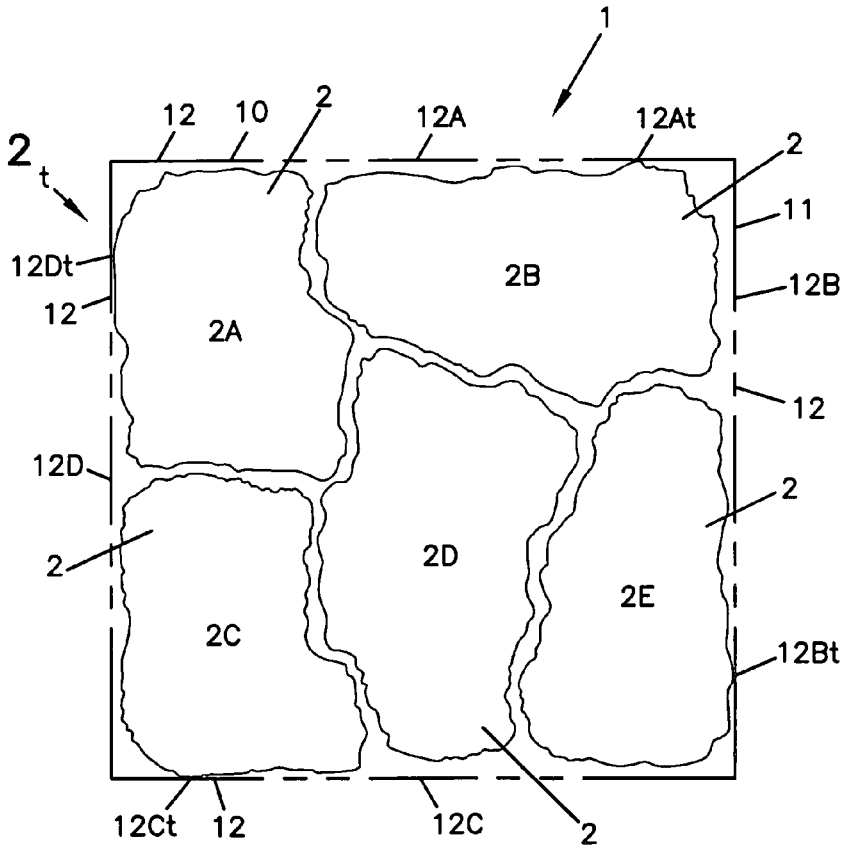
FIG. 2 is a schematic depiction of the set, collection or arrangement of FIG. 1 shown positioned within a hypothetical defining border.

Certain additional general principles relating to the set, collection or arrangement 1 of FIG. 1 (or 100, FIG. 7), will be understood by reference to FIG. 2. Referring to FIG. 2, the arrangement 1 is depicted with a hypothetical defining border 10 there around. The hypothetical defining border 10 is depicted in phantom lines to indicate that it is not a structural component of the collection 1. Rather border 10 is used to further facilitate definition of the collection 1. The particular hypothetical defining border 10 depicted in FIG. 2, is a square 11, having four sides 12; however, alternative shaped hypothetical defining borders 10 can be used, to define sets, collections or arrangements according to the present disclosure. This is discussed below.

Referring to FIG. 2, for the example shown, the hypothetical defining border 10 as indicated above, comprises a square 11 having four sides 12, identified as 12A-12D. The stones 2A-2E of the arrangement 1, for the example shown, are such that they can be assembled within the hypothetical defining border (if appropriately positioned next to one another within the border) in accord with the following:

(1) The stones 2 (in the example shown stones 2A-2E) are each sized such that the sum total of the perimeter areas of all stones 2 in the set, collection or arrangement, is at least 65%, usually at least 70%, and typically at least 75% of the total area defined by the hypothetical defining border 10. When there are five stones 2 within the set 1, typically the sum total of the other perimeter areas of the stones 2 in the set is at least 75% and often at least 80% of the total area defined by the hypothetical defining border 10. When there are four stones in the set, FIG. 7, typically the sum total of the outer perimeter areas of the stones 2 in the set is at least 70%, and often at least 75%, of the total area defined by the hypothetical defining border 10. Typically the sum total of the perimeter areas of the stones 2 in a set (1, FIG. 1; or 100, FIG. 7) is not greater than 95%, and usually not greater than 90%, of a perimeter area defined by the hypothetical defining border.

(2) Each of the sides 12 of the hypothetical defining border 10, in the example shown sides 12A-12D, extends adjacent, and is typically spaced no further than 3 inches (7.62 cm), from a nearest portion of at least two stones in the set or arrangement 1. For the example shown in FIG. 2, border edge 12A extends adjacent portions of stones 2A, 2B; border edge 12B extends along sides of stones 2B, 2E; border edge 12C extends along sides of stones 2C, 2D and 2E; and, border edge 12D extends along sides of stones 2A, 2C. For the four stone set depicted in FIG. 7, border edge 12A extends adjacent portions of stones 2F, 2G; border edge 12B extends along sides of stones 2G, 2H; border edge 12C extends along sides of stones 2H, 2I; and, border edge 12D extends along sides of stones 2F, 2I.

(3) When positioned within the hypothetical defining border 10, each of the stones 2 (in the example shown in FIG. 1 stones 2A-2E and in FIG. 7, stones 2F-2I) can be positioned with a portion no greater than 3 inches (7.62 cm) from a closest adjacent side 12 of the hypothetical defining border 10. Typically, for a set of stones 2 (see sets 1, FIG. 2 and 100, FIG. 7) at least four members of the stone set abut (or at least is spaced no further than 0.5 inches—i.e., 1.27 cm) from an adjacent side 12 of the hypothetical defining border 10.

(4) When positioned within the hypothetical defining border 10, a portion of each of the stones 2 (in the example shown in FIG. 1, stones 2A-2E and in FIG. 7, stones 2F-2I) is positioned with a portion no greater than 3 inches (7.62 cm) and typically no greater than 2.5 inches (6.35 cm) from any adjacent stone 2;

(5) When positioned within the hypothetical defining border 10, a portion of each of the stones 2 (in the example shown in FIG. 1, stones 2A-2E and in FIG. 1, stones 2F-2I) can be positioned with a portion at least 0.75 inches (1.9 cm) and usually at least 1 inch (2.54 cm), from a portion of an adjacent stone. By this, it is not meant that the entire stone is spaced at least this distance from an adjacent stone, but typically it will be when the stones are positioned in a hypothetical defining border as defined;

(6) Adjacent sections or edges of adjacent stones 2 when positioned in the hypothetical defining border, will typically not be mirror images of one another, but rather irregular facing borders in adjacent stones are provided, when the stones are positioned in the border. By this it is not meant that the stone edges may not be general mirror images of one another, only that they are not relatively precise mirror images with the jagged portions of one aligning with mirror image jagged portions of another, adjacent, stone.

(7) Typically no stone 2, within the hypothetical defining border, is surrounded completely by other stones in the same hypothetical defining border.

Figure 7:
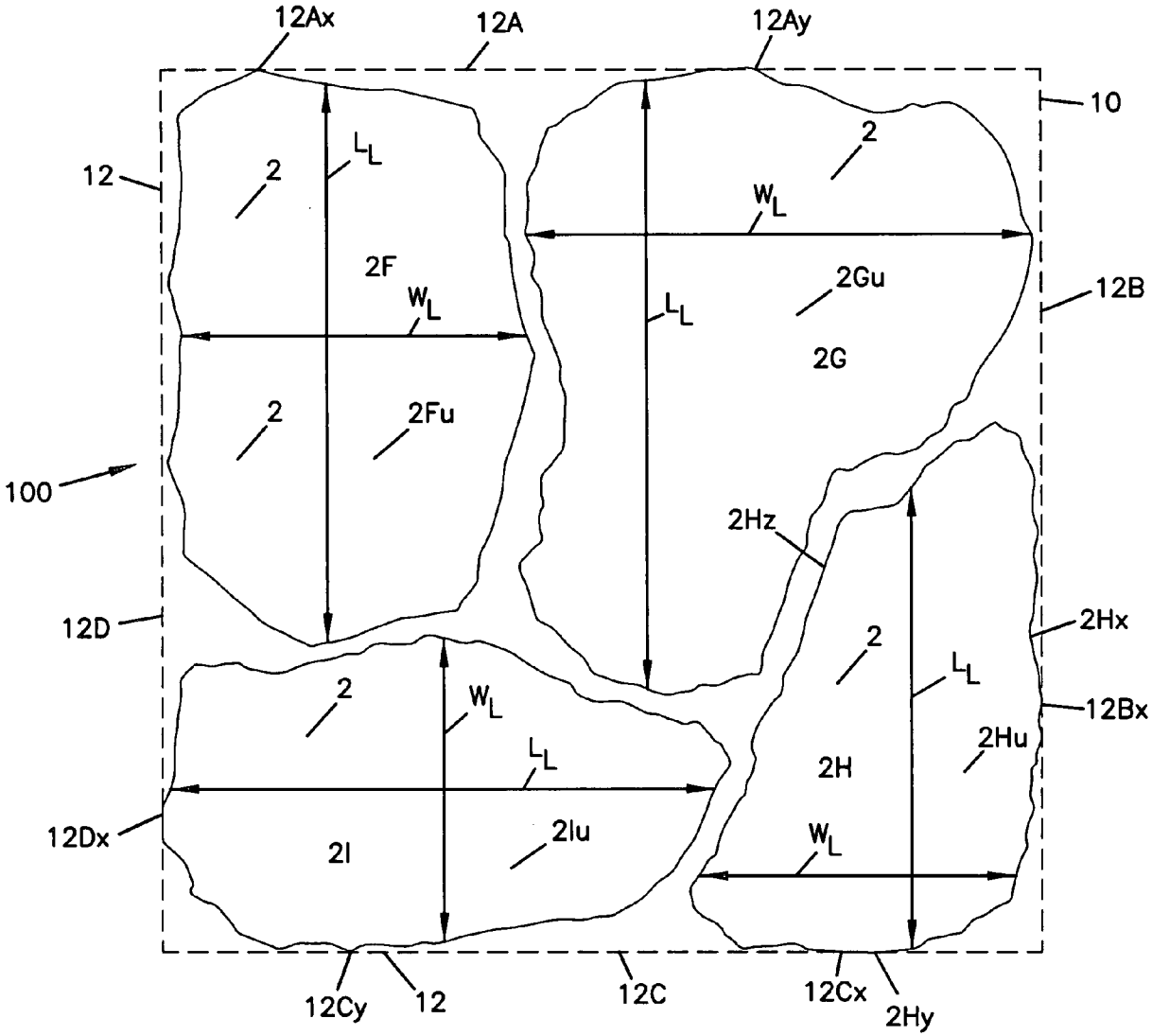
FIG. 7 is a schematic, plan view of a second set, collection or arrangement of molded or cast patio stones according to the present disclosure.

(8) The border 10 is typically sized so that at least three of the sides 12, and typically each one of the sides 12 (in the example shown, in FIG. 2, sides 12A-12D), extends tangential to, or just contacts, a portion of at least one adjacent stone 2. In FIG. 2, such tangential contact is indicated: at 12Dt, for stone 2A and side 12D; at 12Ct, for side 12C and stone 2C; at 12Bt, for side 12B and stone 2E; and, at 12At, for stone 2B and side 12A. In FIG. 7, for set 100 positioned in border 10, such tangential contact is indicated: at 12$A_X$ for stone 2F and side 12A; at 12$A_Y$ for stone 2G and side 12A; at 12$B_X$, for stone 2H and side 12B; at 12$C_X$ for side 12C and stone 2H; at 12 Cy for side 12C and stone 2I; and, at 12$D_X$ for side 12D and side 2I.

In more general terms, individual stones of typical stone sets, collections or arrangements according to the present disclosure, can in part be defined with respect to being sized and shaped to collectively fit within a hypothetical defining border. The hypothetical defining border, then, can be used to define a unit of stones, and selected features as individual stones within the set. The hypothetical defining border can be an artifact corresponding to a mold arrangement useable to form the stones 2 of a given set, collection or arrangement, for example set 1, FIG. 2, or set 100, FIG. 7.

There is no specific requirement that the stones of a set, collection or arrangement 1 be such as to be configurable, collectively, into a hypothetical defining border in accord with each and every one of the principles (1)-(8) identified previously, to obtain at least some advantage from some of the principles described herein. However, typical commercial stones sets, collections or arrangements using advantageous features as characterized herein are generally of this type.

Herein when it is said that "a portion" of each of the stones 2 is positioned no greater than some defined amount from feature or location, it is not necessarily meant that the entire stone edge adjacent the feature defined, is so spaced. Rather it is only meant that at least some portion of the referenced stone 2 is spaced as defined. For example, referring to FIG. 2, for the set, collection or arrangement 1 of stones 2 depicted (stones 2A-2E) along edge 12D stone 2C is not contacted. However at least a portion of stone 2C is within 3 inches (7.62 cm), of the border 12D. Further, stone 2C includes at least a portion spaced no further than 3 inches (7.62 cm), and typically no further than 2.5 inches (6.35 cm), from adjacent stones 2A, 2D.

Herein the term "hypothetical defining border" is merely meant to refer to a border than can be drawn around the set, collection or arrangement of stones, when the stones are appropriately positioned. It is not meant that the stones are necessarily positioned, in use in a patio, walkway or stepping path, in accord with the positioning in the hypothetical defining border. This would be a matter of choice by the landscaper or user, as discussed below.

Also, the above descriptions with respect to the hypothetical defining border (and the stones 2 as molded or cast), are meant to be prior to any cutting or chipping that may be done after formation, for example by the landscaper at a landscaping site.

In a typical arrangement in which a square hypothetical defining border is used to define the set, collection or arrangement, typically the sides of the hypothetical defining border will be at least 36 inches (91 cm) long, often at least 38 inches (96.5 cm) long, typically not more than 43 inches (109.2 cm) long. Typically the sides of the hypothetical defining border are within the range of 38-42 inches, inclusive (96.5-106.7 cm inclusive). A typical example would be 40 inches (101.6 cm) per side.

For the particular examples depicted in FIG. 2, the following example dimensions and features are used:

(a) The hypothetical defining border 10 has dimensions of about 40 inches by 40 inches (101.6 cm×101.6 cm).

(b) Individual stones are as follows:

(1) stone 2A: longest length ($L_L$) 19 inches (48.3 cm), longest width ($W_L$) 14 inches (35.6 cm), perimeter area 1.67 sq. feet (0.155 sq. m.), and, weight (or mass) 32.8 lbs (14.9 kg);

(2) stone 2B: longest length ($L_L$) about 25 inches (63.5 cm), longest width ($W_L$) 15 inches (38.1 cm), perimeter area 2.08 sq. feet (0.19 sq. m.), and, weight (or mass) 41.3 lbs (18.8 kg);

(3) stone 2C: longest length ($L_L$) 19 inches (48.3 cm), longest width ($W_L$) 15 inches (38.1 cm), perimeter area 1.63 sq. feet (0.15 sq. m), and, weight (or mass) 31.5 lbs (14.3 kg);

(4) stone 2D: longest length ($L_L$) 25 inches (63.5 cm), longest width ($W_L$) 14 inches (35.6 cm), perimeter area 2.06 sq. feet (0.19 sq. m), and, weight (or mass) 40.5 lbs (18.4 kg); and, (5) stone 2E: longest length ($L_L$) 24 inches (61 cm), longest width ($W_L$) 13 inches (33 cm), perimeter area 1.71 sq. feet (0.16 sq. m), and, weight (or mass) 33.8 lbs (15.3 kg).

Referring to FIG. 7, a second set collection arrangement 100, as referenced above, is depicted at 2F, 2G, 2H and 2I, within hypothetical defining border 10, in this instance also comprising a square border 12 with sides 12A-12D, each 40 inches (101.6 cm) long. The arrangement 100, FIG. 7, then comprises four stones. For the examples depicted, the stones are as follows:

(1) stone 2F: longest length ($L_L$) 25 inches (63.5 cm), longest width ($W_L$) 16 inches (40.6 cm), and a perimeter area 2.3 sq. feet (0.213 sq. m.) and, weight (or mass) of 45.2 lbs. (20.5);

(2) stone 2G: longest length ($L_L$) 27 inches (68.6 cm.), longest width ($W_L$) 22 inches (55.9 cm), and a perimeter area of 2.97 sq. feet (0.276 sq. m.) and, weight (or mass) 58.4 lbs. (26.5 kg);

(3) stone 2H: longest length ($L_L$) 23 inches (58.4 cm), longest width ($W_L$) 14 inches (35.6 cm), and a perimeter area of 1.65 sq. feet (0.153 sq. m.) and, weight (or mass) 32.4 lbs. (14.7 kg); and (4) stone 2I: longest length ($L_L$) 25 inches (63.5 cm), longest width ($W_L$) 13 inches (33 cm), and a perimeter area of 1.79 sq. feet (0.166 sq. m)and, a weight (or mass) 35.2 lbs. (15.989 kg).

For both sets 1, 100, the stones are typically dry cast stones, with a maximum thickness of about 1.75 inches-2.25 inches (4.45-5.72 cm).

For the examples shown in FIGS. 2 and 7, it can be understood that the longest length $L_L$ is typically taken parallel to a side as the hypothetical defining border 10, and the longest width $W_L$ is taken perpendicular to the longest length $L_L$ for each stone. This is as characterized previously herein.

B. Uses of the Stone Set, Collection or Arrangements 1, FIG. 1; and, 100, FIG. 7.

Stone sets collections arrangements as characterized herein, for example sets 1 (FIGS. 1 and 2) and 100 (FIG. 7) can be used in a variety of manners. Herein examples are provided, utilizing arrangement 1, FIGS. 1 and 2. It is noted that analogous applications of set collection arrangement 100 can be used. Further, the arrangements 1, FIG. 1; and 100, FIG. 7, can be utilized together in some applications.

Figure 3:
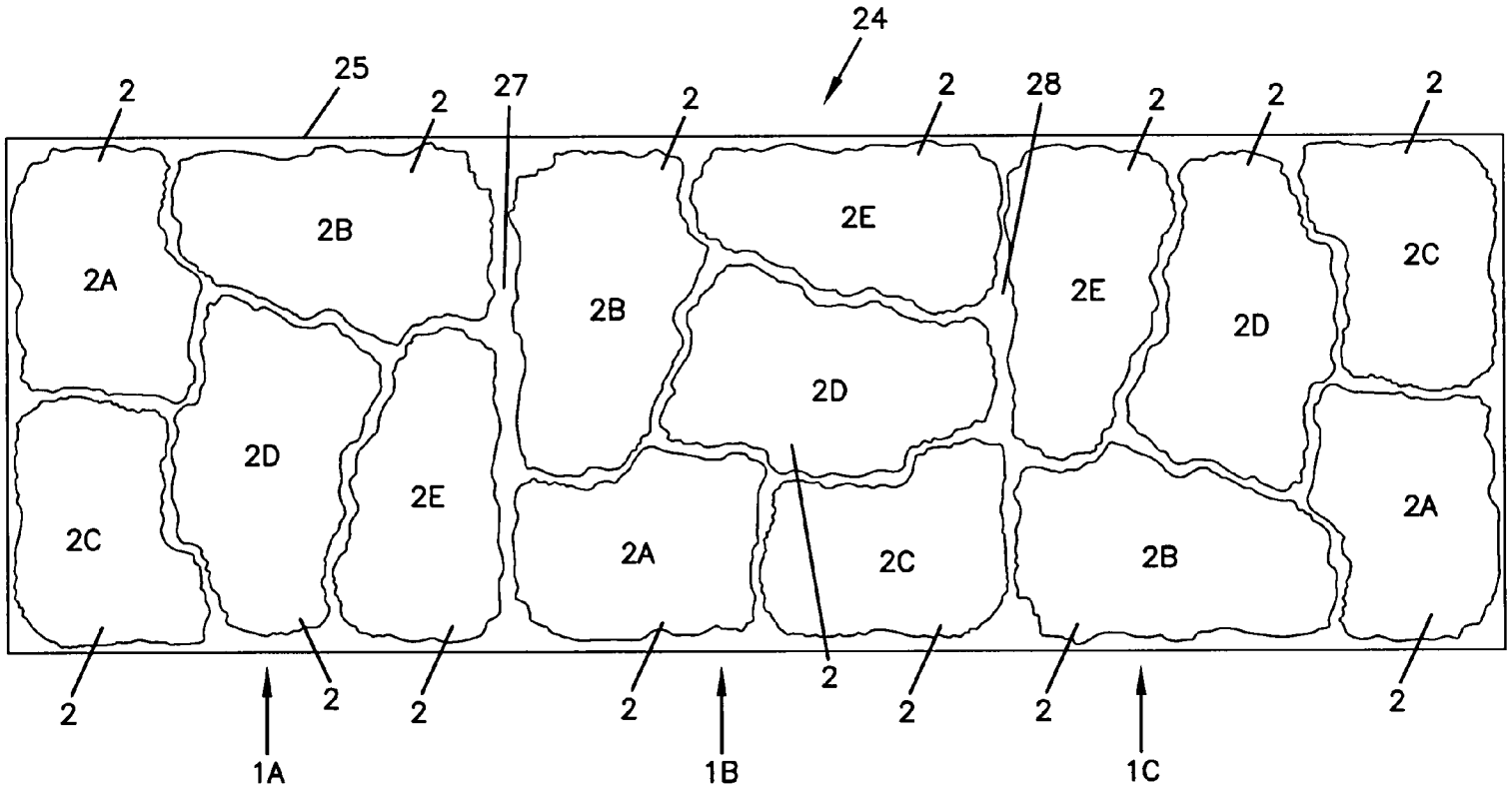
FIG. 3 is a depiction of a patio or walkway section utilizing the set, collection or arrangement of FIG. 1, with stones distributed in an X, Y pattern, as a walkway or patio section.
Figure 4:
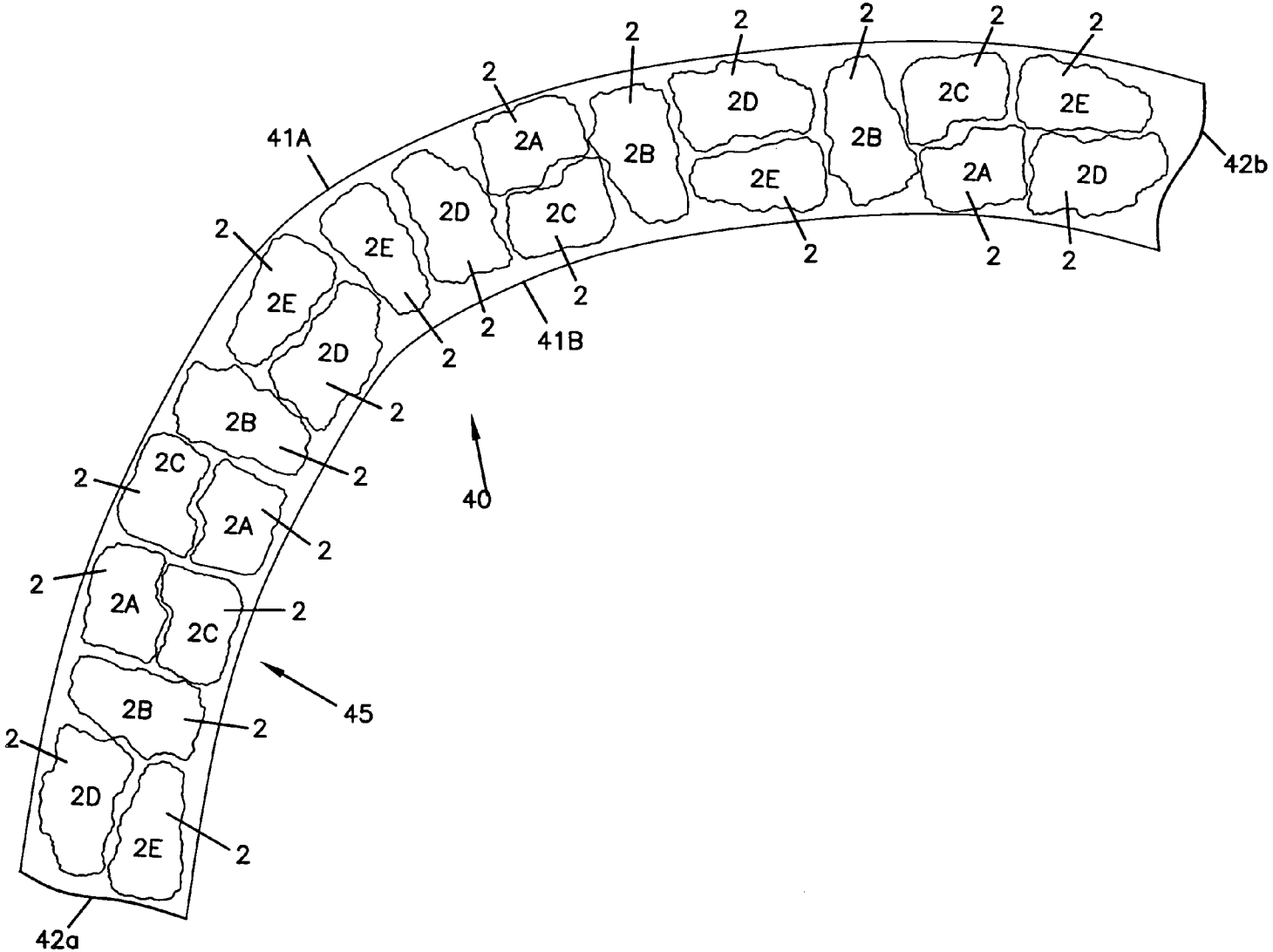
FIG. 4 is a schematic depiction of a walkway section utilizing the set, collection or arrangement of FIG. 1, with the stones distributed in an X, Y pattern, as a walking path.
Figure 5:
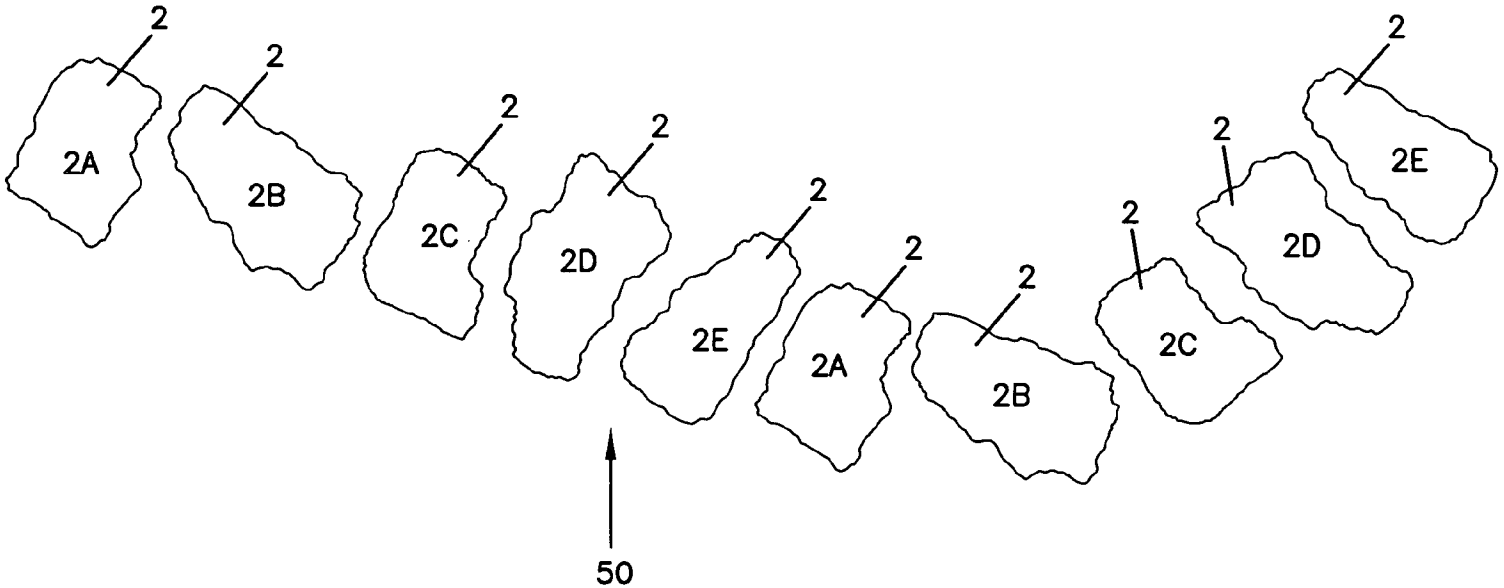
FIG. 5 is a schematic depiction of a stepping path utilizing the set, collection or arrangement of FIG. 1, with the stones distributed only in a curved line.

Individual stones 2 of stone set, collection or arrangement 1 can be used, during landscaping, to provide for a variety of walkway, step way or patio arrangements. Examples of the use of stones 2 in this manner are shown in FIGS. 3-5. It is noted that when used, the stones 2 can be taken out of the arrangement shown in the hypothetical defining border of FIG. 2, and used in different arrangements to form patios, walkways or step ways. Further there is no specific requirement that a walkway, step way or patio utilize all stones of a set collection or arrangement, or that a whole number of sets, collections or arrangements 1 be used.

Referring to FIG. 3, an example is provided of how a walkway or patio section can be defined, utilizing the set, arrangement or collection 1. In FIG. 3, walkway or patio section 24 is depicted schematically, comprising three sets or collections 1, identified as 1A, 1B and 1C respectively. A patio border is indicated at 25. It is noted that each successive one of the collections 1A, 1B, 1C, is rotated 90° (in the example counter clockwise) relative to the next preceding adjacent one. This will provide for a greater visual sense of natural stone, non-repetitive, pattern in the resulting patio section 24. Of course alternate orientations of adjacent sets, collections or arrangements 1 can be used; the incremental 90° counter clockwise rotation shown, merely being an example. Also it is noted that although the example depicted has the sets 1A, 1B, 1C in a linear pattern, larger patio arrangements, with the more than one set, collection or arrangement in each of two directions can be developed.

For the particular patio section 24 depicted, each one of the individual stones 2A-2E, of each collection 1A-1C, has not been moved relative to the others, from the way they appear in the defined collection 1, FIG. 1. Thus, each stone 2A-2E within a collection 1A-1C, is positioned with a portion no greater than 3 inches (7.62 cm) from a portion of an adjacent stone, in each set 1A-1C, and with a portion positioned at least 0.75 inches (1.9 cm) from each adjacent stone 2, within the same set, collection or arrangement 1A-1C.

Figure 3A:
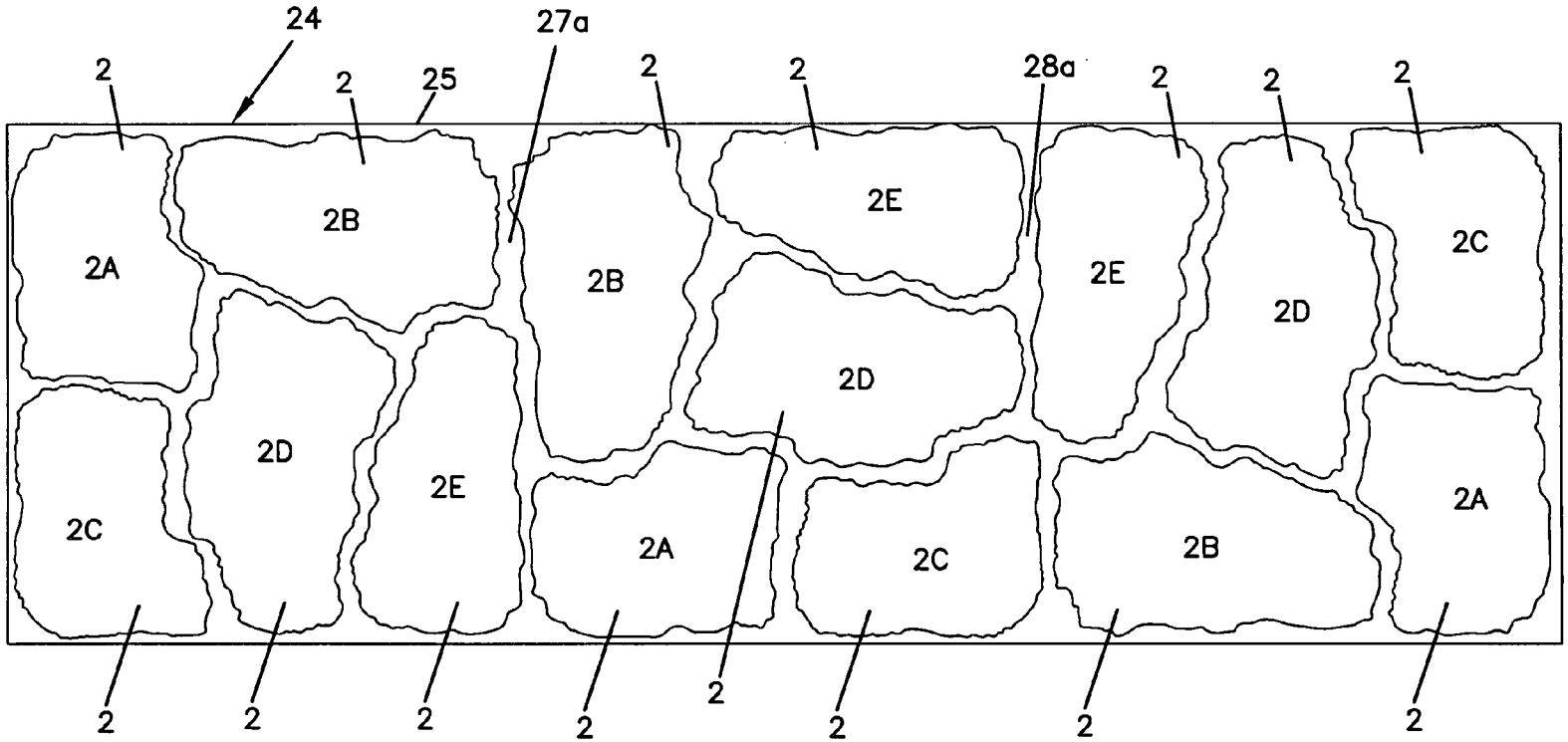
FIG. 3A is a view analogous to FIG. 3, but with the stones depicted slightly shifted relative to one another, to provide an example of an appearance modification.

Referring to FIG. 3A, attention is directed to regions 27*a* and 28*a*, between sets 1A, 1B and 1C. In order to create still further appearance of a natural stone walkway, stones on opposite sides of regions 27 and 28 (FIG. 3) can be shifted, relative to the orientation shown in FIG. 3, to avoid the casual observer's eye from picking up the apparent break or border between stone sections. This is shown in FIG. 3A.

The examples of FIGS. 3 and 3A, show how a stone set, collection or arrangement 1, in accord with the above descriptions for the stones 2 and hypothetical border 10, can be used to create a walkway or patio section 24. In particular, the section 24 can be configured out of a collection or arrangement of the hypothetical defining borders 10. Of course this will not be satisfactory for all walkway or patio shapes or configurations. In some, for example where foundations or other limits are encountered, chipping or cutting of individual preformed stones 2, may be desirable to accommodate the landscaping project. In others, the walkway or patio section can be made from selected ones of stones 2, without using all stones (2A-2E for the examples shown in FIGS. 3 and 3A) of the defined sets. Further, if the patio section is to be used with tables or chairs thereon, maybe it is desirable to positioning the stones relatively close, to avoid table or chair legs catching in the spaces between the stones.

Preparation of the patio section 24, would typically involve creating a paver or landscaped base 27 for the patio, positioning the stones 2 as desired, and then filling in the spaces between and around the stones 2. In many applications a "loose fill" around the stones 2 will be used. The term "loose fill" is meant to refer to a non-permanent fill such as dirt, gravel, or wood chips. In some projects, it may be desirable to use a "fixed fill" between and around the stones 2. The term "fixed fill", is meant to refer to a fill which permanently secures the stones 2 in place, for example a cement or concrete fill.

In the example section 24 depicted in FIG. 3, the individual stones 2 will be sometimes characterized as positioned in an X, Y pattern. The term X, Y pattern in this context, is meant to refer to a pattern in which the individual stones are not merely positioned in a line, but rather a pattern in which many of the stones 2 in the arrangement 24 have adjacent stones on at least two adjacent sides, and typically at least three sides, thereof. The term "X, Y pattern" in the text, then, is meant to refer to a pattern corresponding to a two dimensional plot, as opposed to a line.

Herein the terms "paver base", "landscaped base" and various thereof are meant to refer to any landscaped feature in which the stones would be set for use. This could for example be a sand bed such as a pavement bed, however alternatives are possible.

Figure 3B:
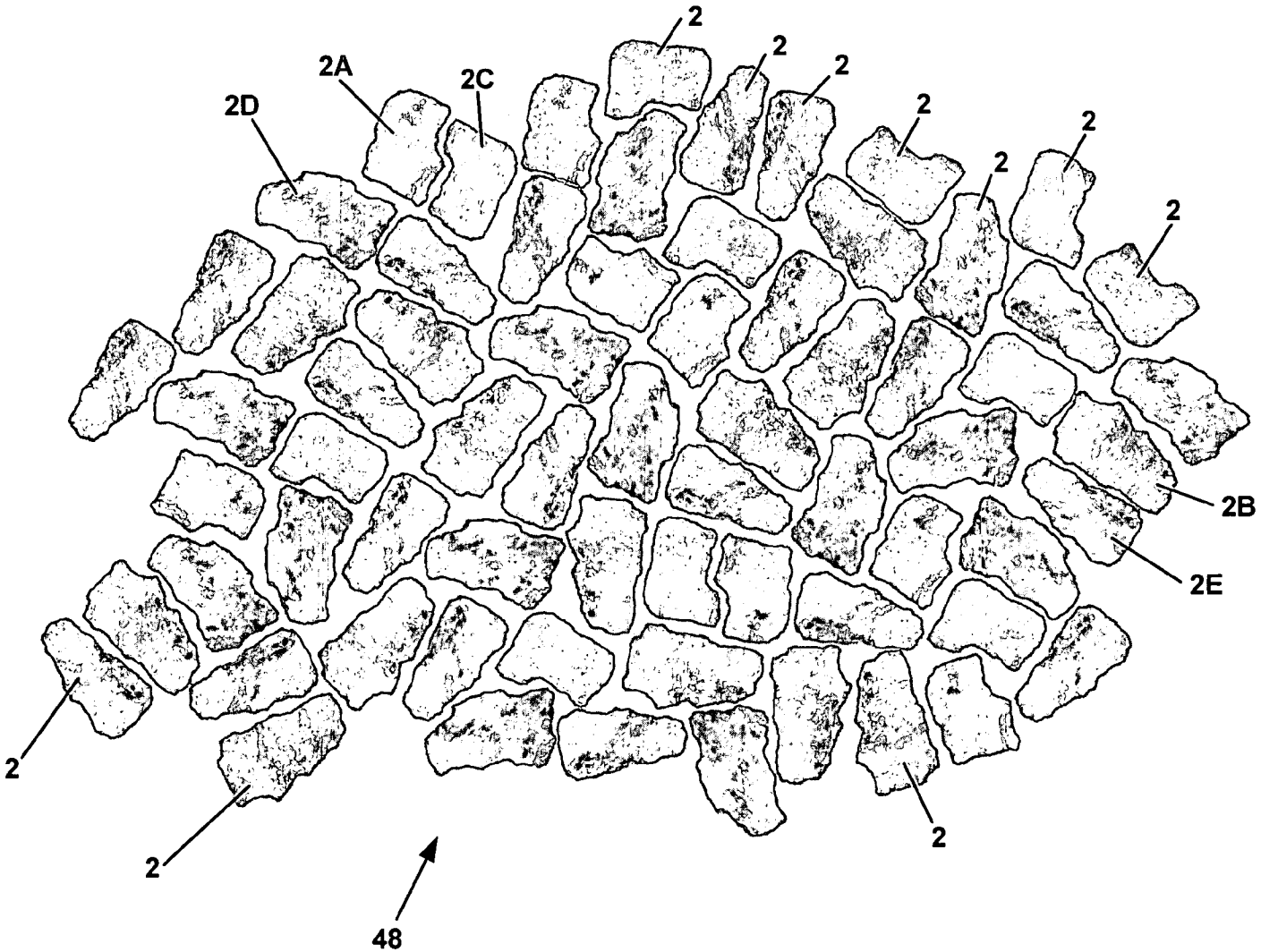
FIG. 3B is a view depicting the stones of FIG. 1 positioned in a patio section in which stones are positioned to have a more random appearance, than in FIGS. 3 and 3A.

Attention is now directed to FIG. 3B. In FIG. 3B, individual stones from sets corresponding to set 1, FIG. 1, are shown oriented in what appears at first to be a somewhat random pattern, in a patio section. The patio section can be made to have a regular, for example rectangular, perimeter or border in several ways. First, a large field or section corresponding to field or section 48, FIG. 3B, can be made individual stones along the edges chipped to form the rectangular or other specific defined shape (not shown). Alternatively, along edges, the landscaper can position stones with outwardly directed edges that generate a somewhat square or rectangular shape.

In FIG. 3B, the stones 2 are depicted with a textured upper surface, which would be a typical manner in which they would be made. Also, it would be understood by review of FIG. 3B, that individual stones 2A-2E, FIG. 1, are shaped with projections or recesses, so that they can be arranged adjacent to one another in a variety of ways. For example, "head-to-toe" arrangements of individual stones 2A, 2C, can be viewed. Also, back-to-back arrangements of stones 2B, 2E, can be seen. It can be seen, from FIG. 3B, that the stones 2 can be used to generate a very natural, random looking, patio section 48.

The particular set of five stones 2A-2E depicted in FIGS. 1 and 2, is usable to form a walkway that is narrower than the length of one side of the hypothetical defining border 10. That is, the stones 2A-2E are particularly sized and shaped, to be rearrangeable into a walking path that is somewhat narrower, for example about 0.5 to 0.75 times (typically about 0.6-0.7 times) the width or length of a side 12 the hypothetical defining border 10. In FIG. 4, a schematic, perspective, depiction of the utilization of stones 2 (in particular stones 2A-2E from set 1) in generation of such a walkway 40 is shown. Referring to FIG. 4, walkway 40 is depicted defined within sides 41A, 41B by stones 2. The walkway 40 is intended to be of indefinite length, and ends 42*a*, 42*b* are depicted fragmented, to show this. This depiction shows a walkway 40 with curved sides, 41*a*, 41*b*. Of course straight sided arrangements, and arrangements with multiple curves can be made, for example using the stones as shown in FIG. 3. In the example shown in FIG. 4, the individual stones 2 are depicted positioned in an X, Y pattern, as the term is used above.

In FIG. 4, an example specific selection of the stones 2 is shown, although alternate arrangements of the stones 2 could be used. From examples of FIGS. 3 and 4, it can be understood that stones 2 from the set, collection or arrangement 1 can be utilized by the landscaper to create a variety of appearances, from the same arrangement 1.

The stones 2 are also appropriate for use as stepping stones in a line or path. This is indicated for example in FIG. 5 at 50. Referring to FIG. 5, stepping path 50 comprises a plurality of stones 2. The particular ones selected from arrangement 1 being indicated at 2A-2E. Of course, an alternate arrangement (or order) of the stones could be used, as well as an alternate number. The particular spacing of the stones 2 within the path 50 is a matter of choice for the given user and project. Typically the stones 2 will be oriented and positioned so that the ideal or natural stepping surfaces are spaced, on center, a distance corresponding to a single step for the intended user. This will typically provide the stones 2 spaced apart no more than about 1.5 feet (46 cm). The stepping path will typically be created by positioning the stones 2 on a grass or ground surface, or by positioning the stones 2 within a landscaped base and surrounded by a loose filler, although alternatives are possible. The stepping path 50, FIG. 5, would not be a "X, Y pattern" as the term has been used herein. Rather, FIG. 5 represents a linear pattern, in this instance a curved line. It is noted that in some instances stepping path, or the stones 2 may be positioned with adjacent stones slightly offset from the line, for example in a somewhat zigzag pattern.

The set, collection, or arrangement 1 is a particularly useful arrangement for a landscaper, since a variety of convenient to define patio walkway and stepping path arrangements can be defined utilizing the same arrangement 1. In addition, if desired by the landscaper, since the stones 2 are cast or molded, a particular color or grain of stones 2 can be chosen, for generation of a constant theme in these features, within the same landscape project. On the other hand, alternate grains or colors, textures, etc. can be chosen, if a contrast in different areas is desired.

Of course the stones 2 (in the example shown stones 2F-2I) of set 100, FIG. 7, can also be used to define walkways and stepping paths, in accord with the previous descriptions. Further, the stones of set 7 can be together with the stones of set 1 when they define a walkway or stepping path. In more general terms, the stones of different sets can be used together, and conveniently, when the sets are defined herein.

Another convenient technique for creating variation, would be to cast sets in accord with a defined set, for example FIG. 1 (or FIG. 7), and also sets in accord with a mirror image of that defined set, for example FIG. 1 (or FIG. 7). These could then be assembled in patios, walkways or stepping paths, to create still further visual variations in the stones to facilitate the impression of a natural stone landscape feature.

II. Further General Characterizations of the Principles Disclosed Herein

In the discussions of Section I above, relating to the arrangement of FIGS. 1 and 7, and the utilization of the stones 2 as described for FIGS. 1-5, and 7, particular sets, collections or arrangements (at 1, FIG. 1 and at 100, FIG. 7), based on a defined square hypothetical defining border, were presented, with utilization of five stones 2 (2A-2E) of irregular, jagged, perimeters for set 1 and four stones 2 (2F-2I) of irregular, jagged, perimeters for set 100, no two stones 2 being identical within a given example set (1 or 100) being identical. The principles of the present disclosure can be applied more generally, as discussed in this section.

First, the set, collection or arrangement, will typically consist of four or more stones. Typically the set will consist of either four or five stones. Usually, the set, collection or arrangement will not include more than six stones, although alternatives are possible.

Typically, the hypothetical defining perimeter into which the set, collection or arrangement of stones can be fit, will be a square. However, alternate arrangements based on other geometric shapes can be selected. For example alternate hypothetical defining borders comprising alternate parallelogram shapes, for example rectangular, can be used. Typically, the hypothetical defining border will be a right angle parallelogram shape, i.e. a four-sided shape with opposite sides parallel, and with each of the corners defining a right or 90 degree angle, specific examples being square (all sides equal) and rectangular (two sets of two opposite, equal sides; the two sets being of different lengths). Selected principles of the present disclosure can be applied in sets that fit non-parallelogram border definitions, however.

The minimum number of stones adjacent each side of the hypothetical defining border can be varied. However, typically the number will be at least two and not more than three, along each side of the hypothetical defining border.

Typically there is no stone within a collection that, when the collection is arranged with the stones side by side within the hypothetical defining border, is completely surrounded by adjacent stones. However, in certain alternative applications, at least one such center stone could be defined.

In general, the set, collection or arrangement (set 1, FIG. 1 or set 100, FIG. 7) of stones 2 is such that within the hypothetical defining border, they occupy a total of at least 65% typically at least 70%, and usually at least 75% of the area defined by the hypothetical defining border. Also, typically no more than 95%, and usually no more than 90%, of the area defined by the hypothetical defining border is occupied by the stones 2. Further each stone of a collection or set typically occupies at least 10% of the area of the hypothetical defining border, typically not more than 30%; usually each is within the range of 12% to 28%, inclusive.

Other typical features for individual stones 2 within a collection, set or arrangement (set 1, FIG. 1 or 100, FIG. 7) can be understood by reference to the examples of FIGS. 1 and 7. For example, when within any given set, collection or arrangement (1 or 100) there is typically at least one stone, and sometimes at least two stones, which define an "irregular boot, sock or L-shaped perimeter". By the term "irregular boot, sock or L-shaped perimeter" in this context, it is meant that the stone defines two leg sections, typically extending at right angles, or nearly right angles, to one another, reminiscent of an L-shape, with each leg section being longer in length than a width of the free end of the other leg section, and also having an irregular and jagged shape. Two examples of this are shown by stones 2A and 2C, insert FIG. 1. Another example is provided by stone 2G, FIG. 7. The term "irregular boot, sock or L-shaped perimeter" as used herein, is meant to refer to the shape whether it is as an "L" or a mirror image thereof; and, without reference to which side is longer. With typical L-shaped stones, the ratio of the length of the longer leg (represented by $L_L$) to the length of the shorter leg, represented by $W_L$, is typically within the range of 1.1-1.6 inclusive; usually within the range of 1.15-1.5, inclusive.

When the set collection or arrangement includes two stones that each have an "irregular boot, sock or L-shaped perimeter", typically those stones are configured so that they can be arranged in a "head-to-toe" form. For arrangement 1, FIG. 1, stones 2A, 2C fit this definition, with the mating relationship shown for example at 45, FIG. 4. Such a relationship is one in which one of the stones is positioned in an upright L, and the other is inverted and placed adjacent, with the toe portions aligned in an overlap manner, as shown at 45, FIG. 4. When there are two stones that have a L-shape, they can be fit together in a head-to-toe manner, allowing additional options for the landscaper, as part of a walking path or patio section, for convenience.

In addition, still referring to FIGS. 1 and 7, typically within any given set, collection or arrangement 1, there is at least one stone (and sometimes at least two stones) that defines a generally irregular triangular shaped outer perimeter. In the example set, collection or arrangement 1 of FIG. 1, there are two such stones identified at 2B and 2E. Each has two outer edges $2B_X$, $2B_Y$ and $2E_X$, $2E_Y$ that, although irregular, generally correspond to the first two sides of a triangle, typically a right triangle, and each has a third side as indicated at $2B_Z$, $2E_Z$, generally corresponding to a hypotenuse. The term "irregular triangular shaped" as used herein in this context, is not meant to refer to the requirement of specific pointed apices (in a geometric triangle) but rather a general shape that is somewhat reminiscent of a triangle (i.e., an irregular triangle). For the example of set 100, FIG. 7, an example irregular, right angle, triangularly shaped stone is provided at stone 2H, with sides $2H_X$, $2H_Y$ corresponding to sides of a right triangle, and side 2Hz corresponding to a hypotenuse.

When the set or collection arrangement includes 2 stone having an irregular right triangular shaped out of perimeter, it is advantageous for those stones are configured so that they can be fit in a head-to-toe manner, providing greater opportunity to the landscaper. Again, this is not a requirement, but does provide advantage.

For typical applications of the principles described herein, each set, collection or arrangement 1 includes at least one stone that has neither an "irregular L-perimeter shape" nor an "irregular triangular shape" as defined above. For the example arrangement 1, FIG. 1, stone 2D corresponds to this definition. For arrangement 100, in FIG. 7, stones 2F, 2G generally correspond to this definition.

Another characteristic of typical of many arrangements according to the present disclosure, especially those including at least five stones, will be understood by further reference to FIG. 1. In particular, in a typical set, collection or arrangement according to the present disclosure, which includes at least five stones, each of the stones 2, for example stones 2A-2E, includes:

(A) at least one recess region in the irregular perimeter, which defines a recess region toward which a projection portion of an adjacent stone can project; and (B) at least one projection portion that extends toward an adjacent recess region of an adjacent stone.

Referring to FIG. 1, example recessed regions are indicated at R and example projection portions are indicated at P. When the projections and recesses are appropriately sized, they facilitate fitting the stones together in different arrangements, for example the head-to-toe arrangement of stones 2A, 2C as an alternative to the arrangement of these stones in FIG. 1; see also FIG. 3B.

A set of stones such as stones 2A-2E, i.e., set 1, with at least one recess portion R of each stone 2 defining a recess toward which a projection portion of an adjacent stone can project, and, at least one projection portion P in each stone 2 that extends toward an adjacent recess region of an adjacent stone 2, will be typical and preferred when the stone set is intended for use in do-it-yourself (diy) landscaping projects, since provision of these projections/recesses facilitate organization of stones into a walkway arrangement or patio section. With stone sets intended for use by professional landscapers, less clearly defined projections and recesses in an irregular, jagged, perimeter will be more acceptable, since professional landscapers are more accustomed to organizing stones in a usable walkway or patio. Thus for the set 100, FIG. 7, any projections/recesses present are less pronounced.

For typical stone sets (for ex. set 4, FIG. 1 and set 100, FIG. 7), according to the present disclosure, it is desirable that the stones be sized and shaped, so that within any set, collection or arrangement the stones 2 do not vary sufficiently, to require being priced differently, or at least substantially differently. It is also desirable that they be such as to lend themselves toward a high speed, low cost, manufacturing. The example stone sets 1 and 100 provided, are suitable for this. Indeed the hypothetical defining borders 10, can be used to define a mold template for construction of the stones 2 of a given set 1 or 100, in a single casting or molding operation. The stone configurations characterized herein, are particularly configured to lend themselves well toward manufacturing in a dry cast process, from a dry cast mix, to advantage.

A dry cast mix will usually comprise a concrete mix (for example cement, sand/aggregate; water; processing agent; colorants) including no more than about 8% by wt. of total content (typically about 4-6%) water. (This is distinguished from a wet cast composition that usually contains 12% or more water content.) A dry cast mix can be press formed into a molded shape, and then removed from the mold immediately (i.e., without waiting for a curing time), without the uncurred, shaped, item losing its shape definition in follow-up caring steps. Another advantage to dry cast materials, by comparison to wet materials, is that the side of the stone opposite the portion of the molding arrangement that forms the stepping surface, will typically be flat, planar, free of protruding irregularities, and will have the granular feel to the dry mix. As can be seen from below descriptions, in a dry cast process this flat side of the stone is generally directed downwardly in the process. In a wet cast process, the stepping surface is generally formed on the bottom, with the side opposite—upper in the mold—being an uncovered upper surface of the wet cast material. This surface will often be a relatively rough non-planar surface, with protruding irregularities resulting from air escape (bubbles, etc.) in the concrete.

Dry cast techniques as described herein are advantageous for stones 2, by comparison to wet cast processes for a number of additional reasons. For example, dry cast materials can be immediately removed from the mold, for caring. Wet cast materials, however, must be hardened within the mold before they can be demolded. Thus, a single mold can be used to cast more than one dry cast item or set per minute, whereas with wet cast molding, the mold must be kept surrounding the west cast item, until substantially cured, typically 12 hours or longer.

The techniques described herein below are to form dry cast stones and can be used to form stones of relatively high strength by comparison to stones formed with a wet cast process. In general, a standardized test method is available from ASTM (ASTM C 99-87 "Modulus of Rupture of Dimension Stone"). In general the test measures the resistance of flexural cracking of a slab (stone) due to loading on an irregular sub-base. The conditions of the test, utilize samples sized nominally 8 inches long by 4 inches wide, with the depth being based upon the manufacturing process. Samples made from a dry cast process, with a thickness of about 1.75 inches, averaged a modulus of rupture of about 999 psi, and a load at failure of about 1,350 lbs. Commercial wet cast stones, thickness 1.5 inch to 1.75 inch typically exhibited lower modulus of rupture (for three different commercial samples tested: 855, 878 and 903 psi); and, lower load at failure (for the three samples tested: 778, 589 and 703 lbs.). In general, it was observed that dry cast stones made according to the principles described herein, are generally statistically stronger than prior wet cast stones of similar thickness. Further, it can be observed that within the conditions of the test, the dry cast stones, when made of appropriate thickness of at least 1.75 inches have an average load at failure of over 1,000 lbs, typically over 1,200 lbs. It can also be said that they have an average concomitant modulus of rupture of at least about 920 psi, and typically at least about 950 psi.

III. Manufacture of Stones and Stone Sets, Collections, Arrangements According to the Present Disclosure The stones 2 will typically be formed in a dry cast process initiated by mixing a dry cast concrete. It can be selected out of a variety of materials, with known techniques, mixed to provide a desired texture, etc., when cast. The concrete mix will typically be chosen to satisfy pre-determined strength, water absorption, density shrinkage and related criteria for the resulting stones, so the stones will be formed adequately for the intended use.

Mold assemblies and portions of mold assemblies useable to practice the techniques described, are illustrated in FIGS. 8-11. A mold assembly will be made from materials, such as steel, that are able to withstand the pressure that is applied during the formation of the uncured dry cast stones, as well as to provide sufficient wear life. The mold assembly is typically constructed so that the uncured dry cast stones are formed with the stepping face facing upward, and with the bottom face supported on a flat pallet, typically a steel pallet, positioned underneath the mold assembly. This permits pattern pressing on the stepping face of the stones, with molded stripper shoes, to form stepping faces that are textured similar to natural stone.

Figure 8:
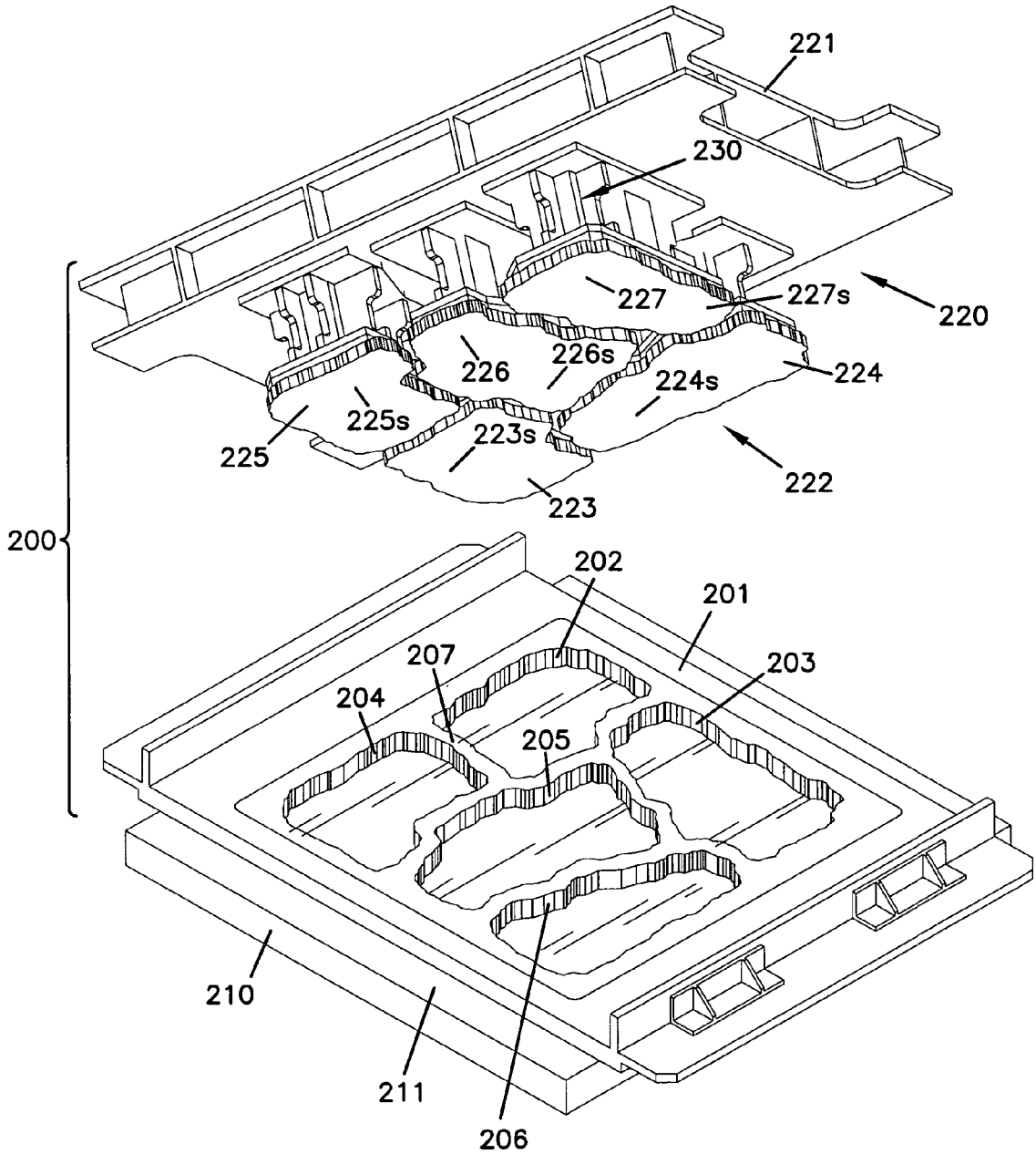
FIG. 8 is a schematic depiction of equipment useable for, and a process step in the production of, a stone set according to FIG. 1.

FIG. 8 is a schematic depiction of an assembly and process step for the formation of a stone set generally corresponding to set 1, FIG. 1. Referring to FIG. 8, the mold assembly is indicated generally at 200, comprising perimeter mold piece 201, including a plurality of cavities or templates 202-206 corresponding to the perimeter shapes of stones 2A-2E respectively, oriented as they would be in a hypothetical defining border 10, FIG. 2. Between the perimeters 202-206 is provided webbing 207. Typically mold piece 201 would be formed from steel.

The mold assembly 200 further includes a pallet 210 depicted schematically and positioned underneath mold piece 201. The pallet 210 includes a flat upper surface 211 oriented to close mold cavities 202-206 underneath.

In a typical high speed manufacturing process, the steel pallet 201 would be carried on a conveyer, to facilitate manufacture. In some manufacturing processes, the steel pallet 210 can be lowered relative to the mold 201; in others the mold 201 is positioned to be raised relative to the steel pallet 210, after the initial casting process, to provide for movement of the steel pallet 210 to a location for drying, and movement of a new steel pallet 210 into position for a next casting step.

During a typical casting operation, the dry cast concrete mix is loaded into the mold cavities 202-206, on top of the pallet 210. A leveling blade or bar arrangement is then pushed across surface 218, of mold piece 201, to level the surface of the cast material within each mold cavity 202-206, and to clear surfaces of mold piece 201 from undesirable obstruction.

The mold piece 201 or a combination of the mold piece 201 and pallet 210 is then vibrated and a press arrangement including stripper shoes is pushed into the cavities 202-206, to compact the dry cast concrete sufficiently. A press arrangement for conducting this operation is shown in FIG. 8 at 220 and comprises base 221, and stripper shoe arrangement 222, in this instance comprising five shoes 223, 224, 225, 226, and 227 sized and shaped to fit within cavities 202-206 respectively. Typically the stripper shoes 223-227 will have the same perimeter shape as the cavities 202-206 respectively, except sized slightly smaller, typically to provide a gap of about 0.02-0.06 inches (0.05-0.15 cm) around the shoes 223-227, when centered within the respective cavities 202-206.

The stripper shoe arrangement 222 is generally positioned on a shoe support arrangement 230, secured to the holder 221. The stripper shoes 223-227 are typically removably supported on the supports 230, for example by bolts, as discussed below.

In many instances, in order to provide for the appearance of natural stone, the surfaces 223S-227S of the stripper shoes 223-227, which will form the stepping or upper surface of the individual stones made in the molding operation, are configured to correspond with a natural stone appearance, i.e., to provide a natural stone texture surface and grain appearance in the product. Such surfaces 223S-227S, are generally milled from steel, such as 8620 steel, using techniques based on patterning natural stone. Examples of such techniques are described in U.S. Patent publication number 2003/0182011 A1 on Sep. 25, 2003, incorporated herein by reference.

In the formation of stripper shoes 223-227, typically the following steps are followed:

1. A stone piece is selected, as a model for the stone surface. The stone piece is generally selected based upon overall appearance and desirable surface characteristics.

2. The surface of the stone piece is digitally scanned, typically in a form to create an image larger than the intended stepping surface.

3. The scanned surface is overlaid on an outline for the intended perimeter of the stone. Typically the scanned surface is oriented so that a grain or texture within the stone does not run perfectly parallel to, or perfectly perpendicular with, the longest length $L_L$, of the resulting stone piece but rather provides a diagonal cross-grain, and thus a more natural appearance.

4. There may be provided some data manipulation either before or after the overlay, or both. Data manipulation can be used, for example, to further limit the amount of surface irregularity, in different regions of the surface. This technique can be used, for example, to provide a somewhat flatter center for the ideal or natural stepping area, versus a more rough outer peripheral area. Further, a radius can be provided around the perimeter of each stone, where the side of the resulting stone will engage the upper stepping surface. For example a 3/16 inch radius (0.48 cm) border may be desirable.

An entire stone set can be made using a scan taken from a slab of stone, such as slate. On the other hand, scans from different slab pieces can be used to create different members of a set. This latter may be desireable for landscaping projects in which it is desired to insur that the stones have an "unmatched" and more natural look.

If desired, drop downs such as shown in FIG. 6 at 9*a* relative to 9*b*, can be implemented either through the original scan, or by manipulations to the data within the scan.

The resulting data file will then be used by an operator of a milling machine, to mill the stripper shoes 223-227, out of an appropriate material, typically steel. Often 8620 steel is used for this purpose. The resulting stripper shoes 223-227, are then mounted on the support arrangement 230.

Figure 9:
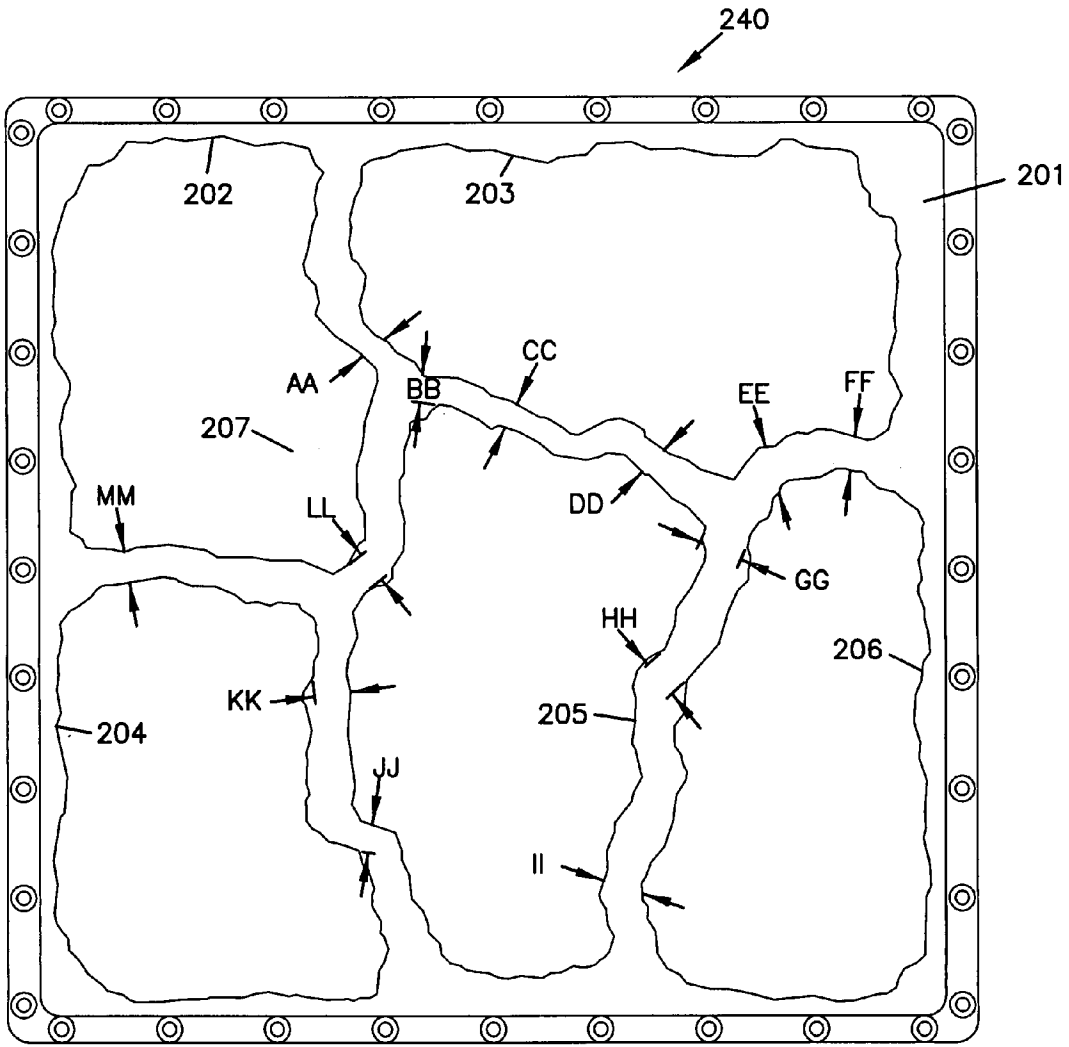
FIG. 9 is a schematic plan view of a portion of a mold piece used in the depiction of FIG. 8.

In FIG. 9, a cavity portion 240 of mold piece 201 is schematically depicted. Example dimensions indicated in FIG. 9 are as follows: AA=1.198 inches; BB=1.235 inches; CC=1.265 inches; DD=1.267 inches; EE=1.736 inches; FF=1.509 inches; GG=2.134 inches; HH=1.725 inches; II=1.700 inches; JJ=1.390 inches; KK=1.559 inches; LL=1.512 inches; and MM=1.448 inches. These dimensions indicate a width of steel in the regions of the webbing 207 to form a molded plate 201 useable to generate stones in accord with set collection arrangement 1, FIG. 1. These dimensions also indicate the typical width of the spacing between stones in the resulting set 1, when positioned in the hypothetical defining border. Other dimensions or spacings within FIG. 9 can be obtained by approximation from the figure.

A typical mold cavity would have a depth of about 2⅛ inches, although alternatives are possible. Typically, the resulting stone may have a maximum height of greater than about 2⅛ inches. However, along the edges, the stone would typically not have a higher height than about 2⅛ inches (the depth of the cavity).

Figure 10:
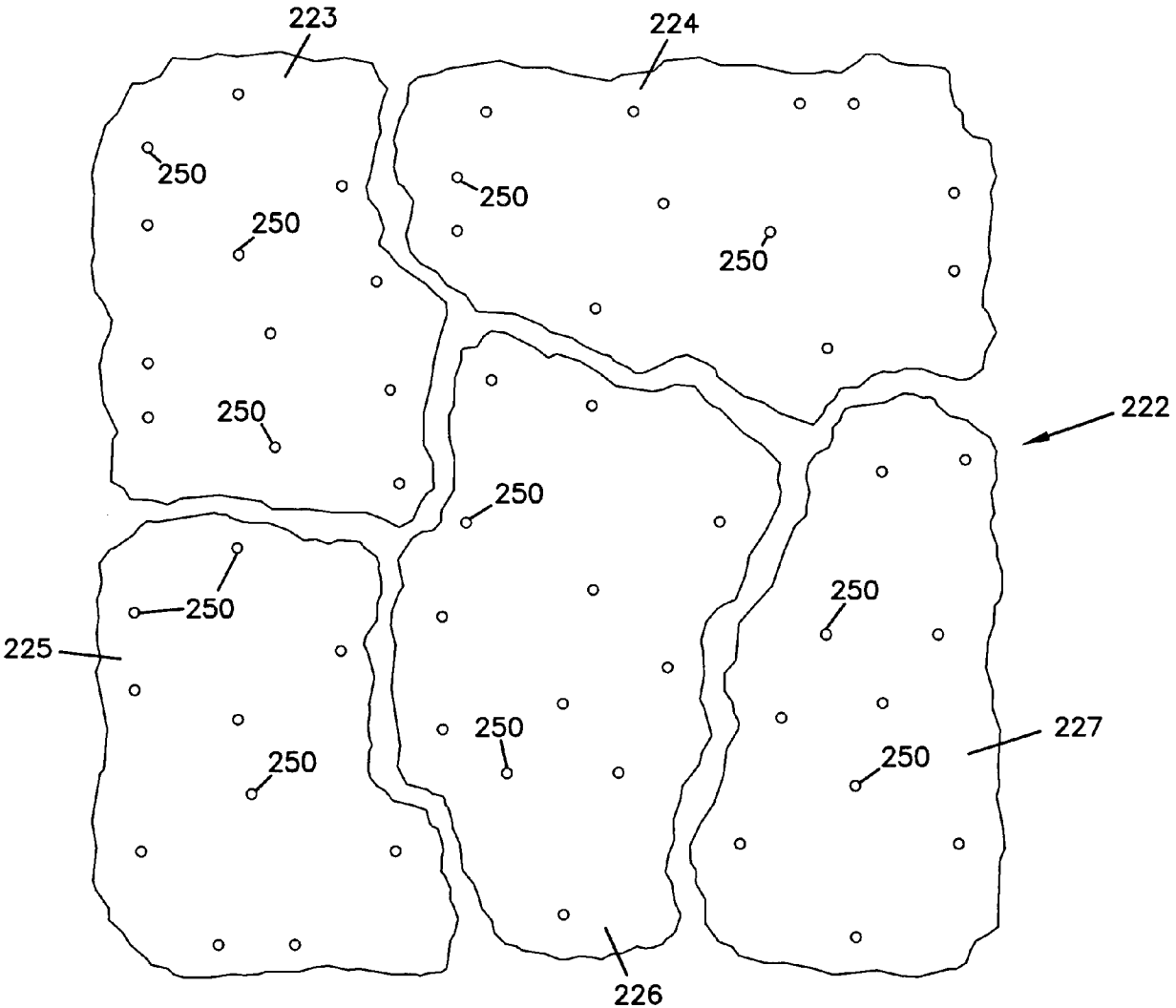
FIG. 10 is a schematic depiction showing mounting bolt locations on a backside of a set of stripper shoes used in the process of FIG. 8.

In FIG. 10, a pattern of bolt apertures 250 and a side of each of the stripper shoes 223-227, opposite the mold surfaces 223S-227S, is shown. These bolt locations are selected for a good distribution of pressure, during the molding operation.

Referring again to FIG. 8, in a typical molding operation press arrangement 220 is pressed into mold piece 201, forcing the shoes 223-227 into the cavities 202-206 respectively. With vibration and compression, the loose dry cast mix is pressed into a firm cast structure. The steel pallet 210 and the mold arrangement 201 are then separated. In some equipment, such a separation occurs by dropping the steel pallet 210 and allowing the head 220 to push the stripper shoes 223-227 through the cavities 202-206. In other arrangements, the mold frame 201 and press arrangement 220 are lifted from the pallet 210. In either case, the pallet 210 is left with the shaped, cast, pieces thereon, to then be cured for example through any of a variety of drying processes such as air curing, auto claving and steam curing. In a typical process, the pieces on the pallet are positioned as a set, collection, or arrangement, within a hypothetical defining border, as discussed herein.

Figure 11:
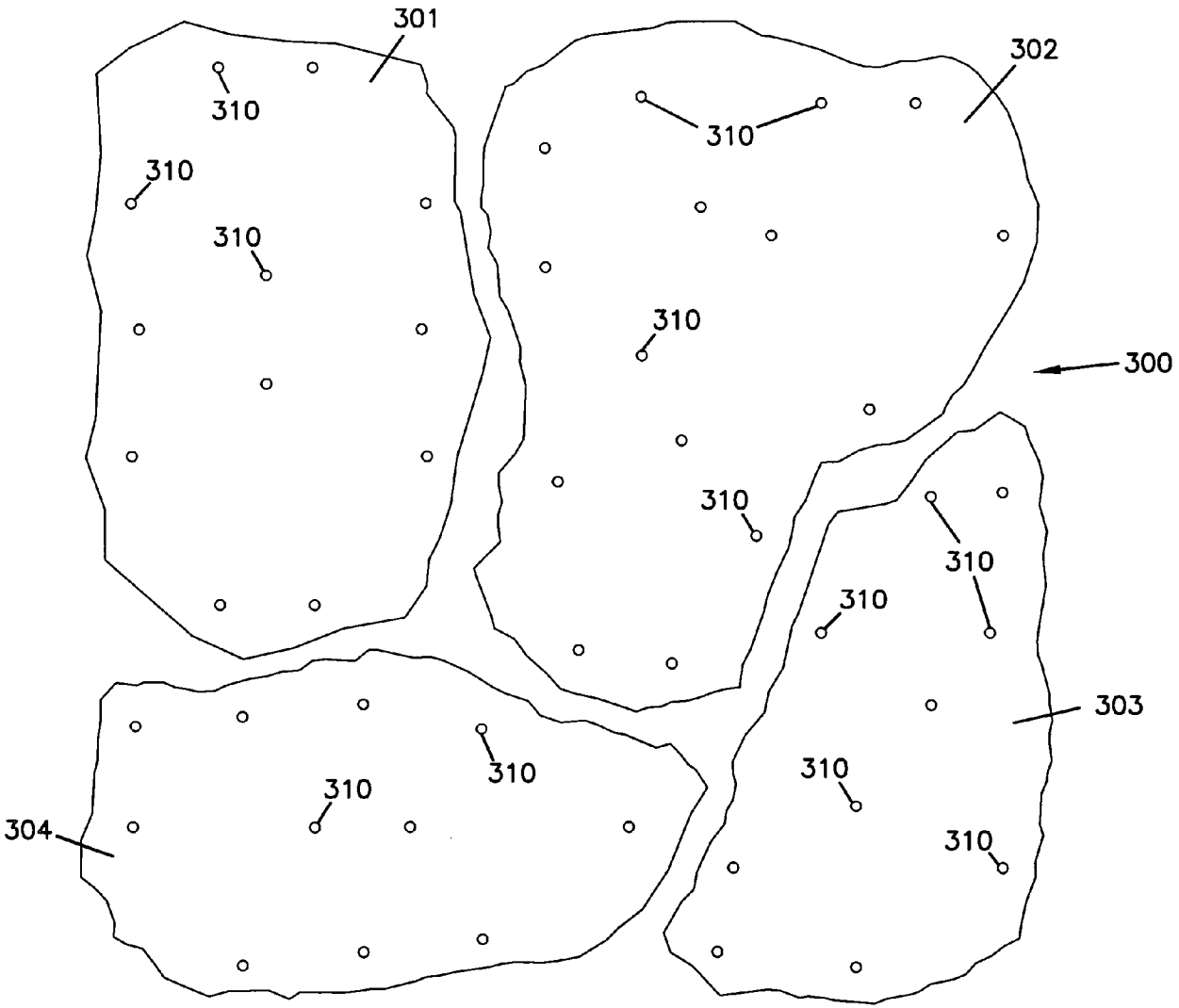
FIG. 11 is a schematic depiction of a backside of stripper shoes useable to form the stone set, collection or arrangement of FIG. 7.

In FIG. 11, an assembly 300 of stripper shoes 301-304 is depicted for formation of stone set 100, FIG. 7. In FIG. 11, the back sides (non-milled sides) of the stripper shoes 301-304 are shown, with bolt holes 310 for mounting.

What is claimed is:

1. A dry cast stone set comprising:

(a) five dry cast concrete stones;

(i) each one of the five dry cast concrete stone having a jagged perimeter: devoid of straight segments each of which is any longer than 3 inches; devoid of any regular pattern of angles and curves; and, devoid of any smooth curve extending over a distance of greater than 6 inches;

(ii) each one of the five dry cast stones having a largest length ($L_L$) within the range of 17-26 inches, inclusive;

(iii) each one of the five dry cast stones having a perimeter area of at least 1.5 sq. feet and not greater than 3.4 sq. feet; and, (iv) the five dry cast stones having a ratio of largest length dimension ($L_L$) to largest width dimension ($W_L$) of at least 1.1 and not greater than 2.5;

(v) each stone having a planar base surface free of protruding irregularities;

(b) no two stones of the set of five stones having the same perimeter shape;

(c) the stone set including two stones each having an irregular, right angle, triangular-shaped perimeter;

(d) the stone set including two stones each having an irregular L-shaped perimeter;

(e) the stone set including a fifth stone having neither an irregular L-shaped perimeter nor an irregular, right angle, triangular-shaped perimeter;

(i) a largest length ($L_L$) of a first one of the triangular-shaped stones being at least as long as a combined width of the second one of the triangular-shaped stones and the fifth stone; when the second triangular-shaped stone and the fifth stone are positioned adjacent one another, in width, to form a minimally wide combination; and, (f) the five stones being positionable adjacent one another to occupy at least 65% of an area of a square border 40 inches by 40 inches.

2. A dry cast stone set according to claim 1 wherein:

(a) the five stones are positionable adjacent one another in a square border 40 inches by 40 inches with each one of the stones positioned no further than 3 inches from the square border.

* * * * *

UNITED STATES PATENT AND TRADEMARK OFFICE

CERTIFICATE OF CORRECTION

PATENT NO. : 7,484,910 B2
APPLICATION NO. : 11/399947
DATED : February 3, 2009
INVENTOR(S) : Jimmie Lloyd Mugge It is certified that error appears in the above-identified patent and that said Letters Patent is hereby corrected as shown below:

On the title page item (73) Assignee: "Donaldson Company, Inc., Minneapolis, MN (US)" should read --Anchor Wall Systems, Inc., Minnetonka, Minnesota (US)--

Signed and Sealed this

Seventh Day of April, 2009

JOHN DOLL
*Acting Director of the United States Patent and Trademark Office*